US011821714B2

(12) United States Patent
Folaron et al.

(10) Patent No.: US 11,821,714 B2
(45) Date of Patent: Nov. 21, 2023

(54) MULTIFUNCTIONAL COMPOSITE PROJECTILES AND METHODS OF MANUFACTURING THE SAME

(71) Applicant: Smart Nanos, LLC, Wilmington, DE (US)

(72) Inventors: Robert Folaron, Colorado Springs, CO (US); Howard D. Kent, Waldport, OR (US); Jennifer Folaron, Colorado Springs, CO (US)

(73) Assignee: Smart Nanos, LLC, Wilmington, DE (US)

( * ) Notice: Subject to any disclaimer, the term of this patent is extended or adjusted under 35 U.S.C. 154(b) by 520 days.

(21) Appl. No.: 16/936,301

(22) Filed: Jul. 22, 2020

(65) Prior Publication Data

US 2021/0108903 A1 Apr. 15, 2021

Related U.S. Application Data

(63) Continuation-in-part of application No. 16/162,179, filed on Oct. 16, 2018, now Pat. No. 10,760,885.

(60) Provisional application No. 62/573,632, filed on Oct. 17, 2017.

(51) Int. Cl.
*F42B 10/48* (2006.01)

(52) U.S. Cl.
CPC ..... *F42B 10/48* (2013.01)

(58) Field of Classification Search
None
See application file for complete search history.

(56) References Cited

U.S. PATENT DOCUMENTS

| | | | | |
|---|---|---|---|---|
| 1,135,357 | A | 4/1915 | Clyne | |
| 4,035,116 | A | 7/1977 | O'Brien et al. | |
| 4,239,006 | A | 12/1980 | Kelson | |
| 4,684,161 | A | 8/1987 | Egner et al. | |
| 4,860,661 | A | 8/1989 | Bock et al. | |
| 4,921,250 | A | 5/1990 | Ayres | |
| 4,961,778 | A | 10/1990 | Pyzik et al. | |
| 5,035,183 | A | 7/1991 | Luxton | |
| 5,164,538 | A * | 11/1992 | McClain, III | F42B 10/24 102/501 |

(Continued)

FOREIGN PATENT DOCUMENTS

| | | | |
|---|---|---|---|
| DE | 10209035 | A1 | 9/2003 |
| DE | 102015007617 | A1 | 12/2016 |

(Continued)

OTHER PUBLICATIONS

Alarcon; "Adult Blood Lead Epidemiology and Surveillance—United States, 2008-2009"; Morbidity and Weekly Report; Jul. 1, 2011/vol. 60/No. 25; pp. 841-845.

(Continued)

*Primary Examiner* — Samir Abdosh
(74) *Attorney, Agent, or Firm* — Thrive IP

(57) ABSTRACT

The present invention is directed to composite projectiles and the manufacture thereof for a wide range of purposes and applications through variation of the composite makeup of such composite projectiles. Embodiments of the invention include composite projectiles configured for manufacture using melt-flow manufacturing methods use-cases and composite projectiles having specialized performance for more effective use in specific use-cases.

5 Claims, 17 Drawing Sheets

(56) References Cited

U.S. PATENT DOCUMENTS

| | | | | |
|---|---|---|---|---|
| 5,237,930 | A | 8/1993 | Belanger et al. | |
| 5,616,642 | A | 4/1997 | West et al. | |
| 5,679,920 | A | 10/1997 | Hallis et al. | |
| 5,760,331 | A | 6/1998 | Lowden et al. | |
| 5,763,819 | A | 6/1998 | Huffman | |
| 5,814,759 | A | 9/1998 | Mravic et al. | |
| 5,852,255 | A | 12/1998 | Hallis et al. | |
| 5,852,858 | A | 12/1998 | Hallis et al. | |
| 5,894,645 | A | 4/1999 | Hallis et al. | |
| 5,917,143 | A | 6/1999 | Stone | |
| 6,074,454 | A | 6/2000 | Abrams et al. | |
| 6,090,178 | A | 7/2000 | Benini | |
| 6,115,894 | A | 9/2000 | Huffman | |
| 6,145,441 | A | 11/2000 | Woodall et al. | |
| 6,257,147 | B1 | 7/2001 | Davies | |
| 6,263,798 | B1 | 7/2001 | Benini | |
| 6,536,352 | B1 | 3/2003 | Nadkarni et al. | |
| 6,649,095 | B2 | 11/2003 | Buja | |
| 6,691,623 | B1 | 2/2004 | Stone | |
| 6,694,888 | B2 | 2/2004 | Jopson et al. | |
| 6,740,260 | B2 | 5/2004 | McCord | |
| 6,799,518 | B1 | 10/2004 | Williams | |
| 7,143,679 | B2 | 12/2006 | Yaich | |
| 7,322,297 | B2 | 1/2008 | Yaich | |
| 7,380,503 | B2 | 6/2008 | Williams et al. | |
| 7,555,987 | B2 | 7/2009 | Powers, Jr. | |
| 7,654,202 | B2 | 2/2010 | Romero | |
| 7,658,137 | B1 | 2/2010 | Romero | |
| 7,685,942 | B1 | 3/2010 | Powers, Jr. | |
| 7,992,500 | B2 | 8/2011 | Williams | |
| 8,028,026 | B2 | 9/2011 | Jain et al. | |
| 8,028,626 | B2 | 10/2011 | Hash et al. | |
| 8,225,718 | B2 | 7/2012 | Joys et al. | |
| 8,308,986 | B1 | 11/2012 | Stuart | |
| 8,312,815 | B1 | 11/2012 | Joys et al. | |
| 8,347,788 | B1 | 1/2013 | Leasure | |
| 8,365,672 | B2 | 2/2013 | Martinez et al. | |
| 8,393,273 | B2 | 3/2013 | Weeks et al. | |
| 8,468,947 | B2 | 6/2013 | Hash et al. | |
| 8,833,262 | B2 | 9/2014 | Leasure | |
| 8,881,654 | B2 | 11/2014 | Seecamp | |
| 8,893,621 | B1 | 11/2014 | Escobar | |
| 8,919,778 | B2 | 12/2014 | Fodera | |
| 8,997,653 | B1 | 4/2015 | Calvert | |
| 9,046,033 | B2 | 6/2015 | Orthmann | |
| 9,057,591 | B2 | 6/2015 | Hash et al. | |
| 9,157,713 | B1 | 10/2015 | Peterson et al. | |
| 9,170,080 | B2 | 10/2015 | Poore et al. | |
| 9,188,416 | B1 | 11/2015 | Hash et al. | |
| 9,194,680 | B2 | 11/2015 | Padgett et al. | |
| 9,227,353 | B2 | 1/2016 | Williams | |
| 9,261,335 | B2 | 2/2016 | Padgett | |
| 9,372,054 | B2 | 6/2016 | Padgett | |
| 9,383,178 | B2 | 7/2016 | Powers, Jr. | |
| 9,388,090 | B2 | 7/2016 | Joshi et al. | |
| 10,126,105 | B2 | 11/2018 | Emke et al. | |
| 11,156,442 | B1 * | 10/2021 | Kampo | F42B 10/48 |
| 2001/0050020 | A1 | 12/2001 | Davis et al. | |
| 2006/0144281 | A1 | 7/2006 | Williams et al. | |
| 2007/0095241 | A1 | 5/2007 | Rice et al. | |
| 2007/0151474 | A1 | 7/2007 | Widener | |
| 2008/0035008 | A1 | 2/2008 | Riess et al. | |
| 2010/0212535 | A1 | 8/2010 | Beal | |
| 2011/0252997 | A1 | 10/2011 | Hoffman | |
| 2014/0318402 | A1 | 10/2014 | Carlson et al. | |
| 2015/0354929 | A1 * | 12/2015 | Minnicino | F41A 21/16 102/520 |
| 2016/0265889 | A1 | 9/2016 | Golloher et al. | |
| 2017/0089672 | A1 | 3/2017 | Burrow | |
| 2017/0314900 | A1 * | 11/2017 | Mahnke | F42B 10/46 |
| 2020/0240758 | A1 * | 7/2020 | Thompson | F42B 10/24 |

FOREIGN PATENT DOCUMENTS

| | | | | |
|---|---|---|---|---|
| EP | 3470769 | A1 * | 4/2019 | F42B 10/08 |
| GB | 2278423 | A | 11/1994 | |
| JP | 2001516008 | A * | 9/2001 | F41G 3/00 |
| KR | 20010025436 | A | 4/2001 | |
| WO | 9738282 | A1 | 10/1997 | |
| WO | WO-2016007212 | A2 * | 1/2016 | F42B 10/22 |
| WO | WO-2022241127 | A1 * | 11/2022 | F42B 10/06 |

OTHER PUBLICATIONS

Beaucham; "Indoor Firing Ranges and Elevated Blood Lead Levels"; Morbidity and Mortality Weekly Report Apr. 25, 2014, vol. 63, No. 16; pp. 347-351.

Final Office Action dated Dec. 23, 2019 in U.S. Appl. No. 16/162,179.

International Search Report dated Jan. 8, 2019 in PCT/US18/56151.

Non-Final Office Action dated May 3, 2019 is U.S. Appl. No. 16/162,179.

Notice of Allowance dated Apr. 22, 2020 in U.S. Appl. No. 16/162,179.

United States Environmental Protection Agency; "Best Management Practices for Lead at Outdoor Shooting Ranges" Revised Jun. 2005; Chapter I, pp. 1-1-1-13.

Written Opinion of the International Searching Authority dated Jan. 8, 2019 in PCT/U18/56151.

* cited by examiner

MULTIFUNCTIONAL COMPOSITE PROJECTILES AND METHODS OF MANUFACTURING THE SAME

CROSS REFERENCE TO RELATED APPLICATIONS

This application is a continuation-in-part of U.S. patent Ser. No. 16/162,179 entitled "Multifunctional Composite Projectiles and Methods of Manufacturing the Same", filed on Oct. 16, 2018 and is currently pending, which claims benefit to provisional patent application No. 62/573,632, entitled "Multifunctional Composite Projectiles and Methods of Manufacturing the Same", filed Oct. 17, 2017, which is incorporated by reference in its entirety for all purposes.

FIELD OF THE INVENTION

The present invention is directed to composite projectiles and the manufacture thereof for a wide range of purposes and applications through variation of the composite makeup of such composite projectiles.

BACKGROUND OF THE INVENTION

A typical projectile, or bullet, as fired from a weapon typically surrounds a projectile having a lead composition. Some of these typical projectiles also have what is commonly referred to as a full metal jacket. A full metal jacket refers to a projectile that uses a soft metallic core, such as lead, surrounded by a harder jacketing material, such as gilding metal or cupronickel. The jacketing material offers a higher level of lubricity for reduced reloading failures as well as reduced friction and wear on parts of the firearm. The full metal jacket design improves firearm feeding particularly surrounding those which use mechanical manipulation for the reloading process. The benefits of improved firearm feeding are particularly important for firearms which are semi-automatic or fully automatic in reloading operation. The metal jacketing also allows for increased muzzle velocity, the speed at which a projectile exits the barrel of a firearm, without leaving significant deposits of metal in the bore. Deposits of metal within the bore can lead to unsafe or unreliable firearm operation.

The first metal-jacketed bullet was introduced in 1882 and the technology used to manufacture bullets has not substantially changed since WWII. Manufacturers have been limited to assembling metals and alloys in incrementally different ways, without an impactful leap in technology to provide the ability to create and execute new and innovative designs.

The main focus point of projectile development surrounds ballistic performance of projectiles to provide longer and flatter trajectory. Other functional developments surrounding projectiles modify the intended use of the projectile by modifying the internal composition of the projectile. For example, certain projectiles use a hardened metal core for armor defeating purposes, while some projectiles use a powdered core material to limit fragments from impacting unintended targets after impacting a primary target.

The standard modern firearm loads and fires projectiles from a cartridge. A modern cartridge typically consists of a casing, which holds all the parts together to be fired as one unit. The casing, typically made of brass, holds a propellant such as gunpowder within, and has a projectile press-fit into the open top. A primer, which is used to initiate the charge of propellant, is integrated into the bottom of the casing.

When the primer is struck, it initiates the propellant charge which then launches the projectile from the casing and through the firearm barrel. A rim, also at the bottom of the casing, allows for the mechanical extraction of the casing from the firearm.

A need now exists for projectiles that are multi-functional, and/or projectiles that can have specifically tailored performance characteristics, and/or projectiles that can be produced with specific physical or material characteristics in a cost-effective, reproducible and time expedient manner. Existing technologies are unable to meet requirements necessary to perform certain tasks effectively without having tradeoffs in performance, reproducibility, safety or cost.

SUMMARY OF THE INVENTION

The present invention utilizes advanced composites and additives with manufacturing techniques to produce composite projectiles for use across a broad spectrum of use cases and functionality. Certain embodiments of the present invention substantially utilize melt-flow processing to produce composite projectiles. It will be appreciated by those skilled in the art that melt-flow processing techniques may include but are not limited to extrusion, roto-molding, injection molding and other processes involving the use of materials in a liquid or semi-liquid state.

Certain embodiments comprise a composite projectile using a polyamide polymer as a binding agent in the manufacture of a composite material. It will be appreciated that polyamides, surround long-chain fiber-forming compounds with recurring amide groups. Certain polyamides, such as Nylon and Polybutylene terephthalate, are widely used due to their characteristics such as: resistance to wear or abrasion, low degradation rates at elevated temperatures, low permeability to gasses, and high chemical resistance. Certain embodiments use Nylon compositions such as Nylon 6, Nylon 66, and Nylon 12. Certain embodiments use singular polyamide composition, while others blend two or more polyamide compositions for mechanical or physical properties inherent in such blends.

Composite projectiles of the present invention may be machined or post-processed into useable projectiles from specified shapes or near-net-shape objects produced from melt-flow processing. The composite projectiles may also be modified prior to loading into ammunition to provide increased, altered or additional performance characteristics. Such modifications may include but are not limited to: coating, plating, or addition of functional elements such as energetic or explosive particles.

In certain embodiments, the energetic or explosive particles of a composite projectile are configured to combust due to high temperature and pressure conditions. The problem with some explosive projectiles which employ combustible materials or heat-activated chemical reaction is associated with what is commonly referred to as "cook-off." Cook-off surrounds the auto-initiation of an explosive projectile. In certain scenarios, this occurs when an explosive projectile is loaded into the breach of a barrel which has been heated through the course of repeated shots fired and remains in the breach for an extended period of time.

In certain embodiments energetic particles having a net positive potential energy based on the structural make-up of the element. For instance, the use of elements commonly known as Prince Rupert drops may provide the explosive characteristics of an explosive projectile without the issues associated with explosive projectiles having combustible characteristics relying upon a chemical reaction. Prince Rupert drops are toughened glass beads created by dripping molten glass into cold water, which causes it to solidify into a tadpole-shaped droplet with a long, thin tail. These droplets are characterized internally by very high residual stresses, which give rise to counter-intuitive properties, such as the ability to withstand a blow from a hammer or a bullet on the bulbous end without breaking, while exhibiting explosive disintegration if the tail end is even slightly damaged.

Projectile manufacturers and designers have been traditionally limited to assembling metals and metal alloys in ways that are limited to specific tools and dies as well as the material. As such, a particular tool or die could be used for only one particular projectile for a specific application. Examples of such applications include close-quarter-combat operations including lethal and less-than-lethal performance characteristics, armor penetrating requirements, demolition requirements, tagging/tracking, and further applications.

It is an aspect of the present invention to manufacture composite projectiles, using a single tool or die, for a variety of applications. By tailoring the functional characteristics of a given projectile through material composition allows the manufacture of composite projectiles for a wide array of applications using the same manufacturing equipment, tooling and processes.

In certain use cases, projectiles designed to pierce armor traditionally include a hardened penetrator encased in a metal jacket. After the projectile is fired from a firearm, the penetrator is released from the metal jacket upon impact with the target. In order to separate and release the penetrator from the jacket, a substantial amount of kinetic energy is expended, thus limiting the maximum penetrating depth of the hardened penetrator.

Certain embodiments comprise a polymeric jacket for a hardened penetrator, resulting in a composite projectile having a lower mass, allowing for a higher velocity muzzle velocity. Furthermore, the polymeric jacket requires a lower level of energy to separate or disintegrate and release the hardened penetrator from the polymer jacket than as compared to a metal jacketed penetrator. Thus, the hardened penetrator of the present invention retains a high level of kinetic energy after release from the frangible polymeric jacket, resulting in a higher maximum penetrating depth.

In certain embodiments, a composite projectile is configured for defeating armor packages, such as ceramic based armor without use of a hardened penetrator. In such embodiments, a composite projectile is configured to deform upon impact to increase the amount of kinetic energy imparted to the armor. The composite projectile deforms but does not fragment to impart the maximum amount of kinetic energy at a localized impact zone. It will be appreciated to those skilled in the art that the defeat of armor does not always require the penetration of all layers of armor. Many armor packages involve a hardened plate with a soft armor backing, or standalone soft armor. It will be appreciated that substantial back-face deformation may result in the defeat of an armor package. Such requirements for the performance and defeat criteria of armor can be found in standards such as those provided by the National Institute of Justice (NIJ). (National Law Enforcement and Corrections Technology Center. Selection and Application Guide to Personal Body Armor [online]. NIJ Guide 100-01. Rockville, Md.: National Institute of Justice, 2001 [Retrieved on 2018-10-005]. Retrieved from the internet <URL: https://www.ncjrs.gov/pdffiles1/nij/189633.pdf>)

In certain embodiments the configuration of a hardened penetrator is adjusted in preparation for manufacture to achieve the desired on-target characteristics of the armor penetrator round. In certain embodiments, a flatter base is desired on a hardened penetrator. In certain embodiments, a shorter aspect ratio is preferred. Modification to aspects such as the base profile, aspect ratio and included angle of the leading end of the hardened penetrator provide modifiable elements to affect the on-target characteristics of the hardened penetrator. In certain embodiments the location of the hardened penetrator within the composite projectile can be modified in the manufacturing process to provide preferred on-target characteristics. For instance, a hardened penetrator located toward the trailing end of a composite projectile in certain embodiments is preferred for use-cases in which a soft target will be encountered prior to a hardened target. In contrast, a hardened penetrator located toward the leading end of a composite projectile in certain embodiments is preferred for use-cases in which a hardened target will be encountered prior to a soft target.

Existing metal jacketed projectiles when fired result in metal-on-metal contact with the internal surfaces of a barrel which may cause wear on the internal surfaces. This metal-on-metal contact is characterized by a high level of friction resulting in rapid increases of heat within the barrel. It is appreciated by those skilled in the art, that repeated firing of a weapon in rapid succession results in the rapid increase in temperature of a barrel. The overheating of a barrel may lead to degradation of accuracy, permanent damage to the barrel or even catastrophic failure of the firearm.

Certain embodiments of the present invention reduce friction between a composite projectile and the interior surface of a barrel by using a polymeric jacket or thin predominantly polymeric layer for a composite projectile, particularly for the surfaces of the composite projectile that directly contact the interior surface of the barrel. A polymeric jacket provides increased lubricity over the prior art and reduces friction and heat generated within the barrel of a firearm.

In certain use cases, traditional firearm projectiles are intended for the purposes of breaching through a door or other closure to access. Such use cases involve the use of a breaching round. A breaching round, typically fired from a shotgun, is a projectile intended for firing at close ranges, e.g. 6 inches (15.2 cm) or less, at the hinges of a door or the area between the lock and doorjamb. These rounds are intended to turn into relatively harmless fragments and are intended to prevent injury to surrounding personnel, thereby limiting collateral damage such as unintended injuries and death. Although traditional breaching rounds are effective at providing access to personnel through a locked door, these rounds often cause collateral damage due to unfragmented portions of the projectile after impact. Furthermore, the use of a breaching round typically requires carrying a secondary weapon, such as a shotgun, specifically for the purpose of breaching. Carrying a secondary weapon to serve a singular purpose requires personnel to carry more weight than otherwise necessary. By eliminating the need for a secondary weapon for a singular application, such as door breaching, this allows a user to carry less weight or reallocate the available payload to other necessary supplies.

Certain embodiments of a composite projectile for use in applications, such as door breaching and/or neutralization of organic and inorganic targets, comprise a hollow-point tip. A hollow-point tip causes more rapid deformation of a composite projectile when the composite projectile impacts a target. For breaching applications, higher velocities are typically undesired as at a certain threshold, the composite projectile punches through a breaching target such as a lock or hinge rather than breaking it. The more rapid deformation of a composite projectile used for breaching, provides a larger surface area and allows the composite projectile to impart more energy across a larger surface area. The larger impact surface area allows for higher muzzle velocity and higher kinetic energy delivery to the target while breaking the target instead of punching through the target.

Certain embodiments of the invention comprise a breaching round version of a composite projectile which fragments into particulate upon impact to mitigate collateral damage, which is capable of being fired from a primary weapon. Thus, the primary weapon is still functional for use in close quarters combat and general-purpose use, limiting unnecessary weight carried by armed personnel.

It is a further aspect of certain embodiments for a composite projectile to impart a maximum level of kinetic energy upon the target. By imparting a maximum level of kinetic energy upon the target, any fragments resulting from the impact have low levels of kinetic energy remaining, thus limiting the ability of fragments to cause collateral damage.

Certain embodiments comprise a breaching round capable of being fired from a side-arm, such as a pistol, while maximizing the amount of energy imparted upon the target. Thus, limiting the need to carry a single-purpose large secondary weapon such as a shotgun for breaching purposes.

Some existing projectiles used for training purposes have an inner lead core and metal jacket. Such projectiles pose a risk of injury to nearby personnel due to ricochet or penetration through an unintended target. Many training facilities make use of moveable targets made of hardened metal. The movability of the target allows the absorption of ballistic energy while the hardened metal of the target provides inertial mass and resilience for the target. However, it is not uncommon for projectiles to strike these targets and ricochet, posing a potential injury risk to nearby personnel.

Certain training facilities are commonly referred to as a shoot-house. A shoot-house is a live ammunition small arms shooting range used to train military and law enforcement personnel for close contact engagements in urban combat environments. Shoot-houses are designed to mimic residential, commercial and industrial spaces. Shoot-houses are often used to acquaint personnel in infiltrating structures and the methods used to overwhelm the target(s) in the quickest and most efficient manner. Shoot-houses are modified to resemble a residential environment and with walls and floor fortified to safely absorb rounds fired from close range. Certain embodiments comprise a composite projectile having limited kinetic energy which can be used in shoot-houses.

Certain embodiments comprise a frangible composite projectile intended to turn to dust or very small particulate upon impact while providing ballistic characteristics similar to that of a standard projectile with lead core and metal jacket.

In use for target practice and training, certain existing projectiles using a lead core present an environmental and health concerns. Outdoor ranges are particularly harmful to the local biology and ground water. Best management practices have been published by the EPA (Environmental Protection Agency. Best Management Practices for Lead at Outdoor Shooting Ranges. Region 2. Revised June 2005. [Retrieved on Oct. 13, 2017]. Retrieved from the Internet: <URL: https://www.epa.gov/lead/best-management-practices-lead-outdoor-shooting-ranges-epa-902-b-01-001-revised-june-2005>EPA-902-B-01-001) detailing the harmful effects of lead exposure to the surrounding environment as well as to humans. Furthermore, the Center for Disease Control has identified indoor shooting ranges as being a leading cause of non-occupational exposure to lead poisoning (Center for Disease Control. Morbidity and Mortality Weekly Report, Apr. 25, 2014, Vol. 63, No. 16 [Retrieved on Oct. 13, 2017]. Retrieved from the Internet: <URL: https://www.cdc.gov/mmwr/pdf/wk/mm6316.pdf> MMWR/Apr. 25, 2014/Vol. 63/No. 16).

Certain embodiments to comprise a frangible composite projectile configure to disintegrate into small particulate upon impact while providing ballistic characteristics similar to that of a standard projectile with lead core and metal jacket. By disintegrating into small particulate, this mitigates the risk of fragments of the composite projectile from causing collateral damage.

The cost of manufacturing projectiles typically involves assembly lines in which molten metal, typically a lead alloy, is cast into shapes and sizes corresponding to certain projectile specifications and configurations. It will be appreciated, to those having skill in the art, that the casting of lead based projectiles involves multiple steps for casting, jacketing and preparing a projectile through manufacture. Certain embodiments comprise a composite projectile which can be manufactured using efficient manufacturing processes rather than those used for the manufacture of lead based projectiles. Certain embodiments present composite projectiles which may be produced with efficient manufacturing processes such as melt-flow manufacturing, such as injection molding.

Variations of the present invention may be used in scenarios when armed personnel must operate in a closed structure, such as a house or apartment building. Risk is involved when armed personnel operate in closed structures where adjacency of rooms put uninvolved targets, such as other persons, into positions of consequence. Typical projectiles can penetrate through building materials, such as drywall or wood. If such projectiles do not hit their intended targets, there is risk of the projectile penetrating building materials or other inconsequential objects and striking an unintended target of consequence such as a person. Traditional projectile design and manufacturing techniques are limited when attempting to minimize penetration characteristics of a projectile, and provide limited effectiveness. Certain existing solutions describe specific metal failure points to facilitate a projectile fragmenting upon impact. These metal failure points have inconsistent results due to the unpredictable flight path of fragmented metal and associated kinetic energy with dense materials such as metals.

Certain embodiments comprise a composite projectile with frangible characteristics such that the composite projectile fragments into particulate less likely to impart collateral damage after impact with an object.

By controlling the material composition of a polymeric aspect of the composite projectile, such as microparticles or nanoparticles of metal and other microparticles or nanoparticles, such as carbon nanoparticles, the performance aspects of a composite projectile may be designed for a particular intended use. It will be appreciated by those skilled in the art, that the use of nanoparticles, particles having a dimension of 100-nanometers or less, in material composition can alter the physical properties of a base material. The effect of nanoparticles upon a base material in manufacturing is largely due to the large surface area of the material, which dominates the contributions made by the small bulk of the material. For example, 1 kg of particles having a volume of 1 mm^3 has the same surface area as 1 mg of particles having a volume of 1 nm^3. As a result, a small amount of nanoparticles, typically less than 10% of a base material results in large physical property changes. It will be further appreciated that certain desired effects may be imparted upon a base material using particles larger than nanoparticles. It may be desired to use microparticles to impart certain desired effects upon a base material. It will be appreciated that micro particles are particles between 0.1-999 microns. Certain embodiments comprise a mixture having a base material, and 5% or less of the mixture comprises nanoparticles or microparticles used to impart desired physical property characteristics upon a composite projectile. In certain embodiments, only 3% or less of the mixture comprises nanoparticles or microparticles.

Certain embodiments of the present invention use carbon particles having a maximum dimension of 50 microns, while in other embodiments it is desired to use carbon particles having a maximum dimension of 20 microns. It will be appreciated that carbon particles may comprise forms of spheres, platelets, tubes, fibers or other form as appreciated by those skilled in the art.

In certain embodiments, it may be desired to use clay particles in a mixture. In certain embodiments, the clay particles nanoparticles or microparticles, often referred to as nanoclay. Nanoclays are nanoparticles of layered mineral silicates. There are several classes of nanoclays, including montmorillonite, bentonite, kaolinite, hectorite, and halloysite. Organically-modified nanoclays, sometimes referred to as organoclays, are a class of hybrid organic-inorganic nanomaterials with known benefit in polymer nanocomposites, as rheological modifiers, gas absorbents and drug delivery carriers.

In certain embodiments, it may be desired to use diamond microparticles or nanoparticles. Diamond particles at such a scale can be used to promote lubricity, polishing and reduce residue build-up within the barrel of a firearm.

It will be appreciated that in certain use cases, a composite projectile having an accurate ballistic trajectory for only a limited range is desirable. For example, for use in close quarters combat or for purposes of short-range training ammunition (SRTA). Certain embodiments for use as a limited range projectile employ the use of drag-inducing elements intended to cause a more rapid deceleration of a composite projectile in contrast with typical efforts to increase longevity of velocity and trajectory of a composite projectile. Furthermore, the use of drag-inducing features serve to destabilize the composite projectile. A drag-inducing element in certain embodiments causes the deceleration of a composite projectile to lower velocities at which turbulent effects from the drag-inducing elements causes asymmetrical drag. The asymmetrical drag causes the composite projectile to wobble or tumble through the air rather than maintain an orientation in which a longitudinal axis is parallel or tangential to the trajectory of the composite projectile.

It will be appreciated that the drag-inducing elements of certain embodiments of the present invention are intended to disrupt the aerodynamic stability of the projectile within a certain range or after passing through a certain medium. The benefits of disrupting the aerodynamic stability of a projectile include decreasing the chances of collateral damage if a projectile misses or passes completely though a target. By disrupting the aerodynamics of a projectile, the effective range within which it is lethal or can cause collateral damage is considerably decreased.

Certain embodiments of the present invention comprise a projectile having drag-inducing elements with a trailing aspect of the drag-inducing elements which are intended to create drag and disrupt the aerodynamic stability of the projectile. In such embodiments these trailing aspects of the drag-inducing elements are characterized by surfaces orthogonal to the path of travel of the projectile or other such characteristics.

In certain embodiments a composite projectile comprises a rebated base. It will be appreciated that a rebated base in certain use-cases enhances the molding manufacturing process and enhances ballistic trajectory and accuracy in use.

In certain embodiments, a composite projectile comprises an ogive on the external profile of the composite projectile. It will be appreciated that an ogive, such as a tangent or secant ogive can be utilized for the purposes of augmenting the aerodynamics of a composite projectile or increasing interaction of a composite projectile with the internal surfaces of a barrel for alignment and firing purposes.

Standard projectiles having a hardened penetrator within the body of the projectile typically comprise an outer jacket of copper or cupronickel and a hardened penetrator potted within the outer jacket with a potting metal such as lead or similar metal having a relatively low melting point. In certain use cases, the heat from the initiation of the charge softens the potting metal and allows the hardened penetrator to shift prior to or during flight. The shifting of a hardened penetrator within a projectile can cause the projectile to become unbalanced and cause unfavorable ballistic trajectory or characteristics.

It is an aspect of certain embodiments of the present invention to prevent the shifting of a hardened penetrator within the projectile such as caused by the heat from initiation of a propelling charge. In certain embodiments, a cap is affixed to the trailing end of a composite projectile to shield the base of the composite projectile from the heat of the initiation of the propelling charge.

In certain embodiments it is preferred that a composite projectile fragments in a predictable and repeatable manner to control penetration on-target, post-target, or in the event the composite projectile does not strike an intended target. Certain embodiments of a composite projectile comprise a tapered element at the leading portion of a composite projectile. A tapered element, such as a cone, is oriented such that the tapered element tapers from the leading portion of the composite projectile toward the trailing end of the composite projectile. As such, the impact of the trailing end of the composite projectile results in an initiation of expansion of the composite projectile upon impact with any target. The initiation of expansion causes an expanding effect which results in lower velocity and rapid dispersion of kinetic energy.

Existing challenges with the manufacture of armor penetrating ammunition include the alignment of the hardened penetrator within a projectile. The alignment of the hardened penetrator with the axial center of mass of the projectile is critical to the balance and ballistic performance of the projectile. It is an aspect of certain embodiments to provide the ability to consistently and repeatably orient a hardened penetrator within a composite projectile to align the axial center of mass of the hardened penetrator with that of the composite projectile. Certain embodiments comprise an alignment element comprising material substantially similar to the material which aligns the hardened penetrator for the molding process through which the alignment element becomes integral to the composite projectile through the molding process of a composite projectile. In certain embodiments the alignment element comprises a metallic structure such as an open-cell metallic structure configured to allow molten polymer to permeate throughout the alignment element. Thus, the alignment element becomes integrated into the composite projectile.

It is an aspect of certain embodiments to utilize a penetrator comprising a malleable material such as copper or cupronickel.

In the existing prior art, a hardened penetrator is inserted into a metal jacket prior to being potted in with a lower melting point metal such as lead. As such, the form of existing hardened penetrators is limited to an axial profile having a consistent form as external features may result in inconsistent potting of the hardened penetrator and potential for voids or air-gaps within the construction of the projectile, which would leave the projectile unbalanced.

It is an aspect of the present invention to allow the use of hardened penetrators having external profiles having external features.

These and other advantages will be apparent from the disclosure of the inventions contained herein. The above-described embodiments, objectives, and configurations are neither complete nor exhaustive. As will be appreciated, other embodiments of the invention are possible using, alone or in combination, one or more of the features set forth above or described in detail below. Further, this Summary is neither intended nor should it be construed as being representative of the full extent and scope of the present invention. The present invention is set forth in various levels of detail in this Summary, as well as in the attached drawings and the detailed description below, and no limitation as to the scope of the present invention is intended to either the inclusion or non-inclusion of elements, components, etc. in this Summary. Additional aspects of the present invention will become more readily apparent from the detailed description, particularly when taken together with the drawings, and the claims provided herein.

BRIEF DESCRIPTION OF THE DRAWINGS

FIG. 9B—A side view of a composite projectile of certain embodiments

FIG. 9C—A front view of a composite projectile of certain embodiments

DETAILED DESCRIPTION

Figure 1:
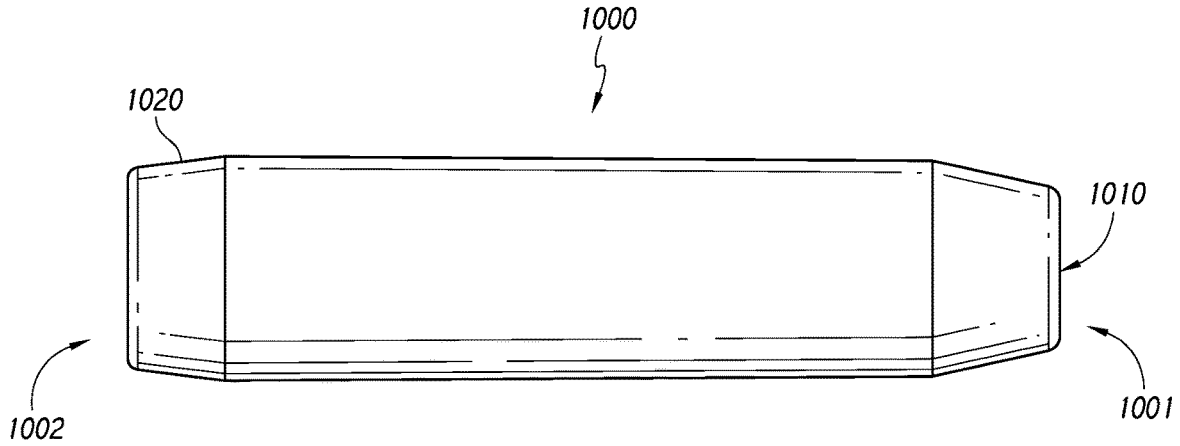
FIG. 1—A side view of a composite projectile of certain embodiments
Figure 2:
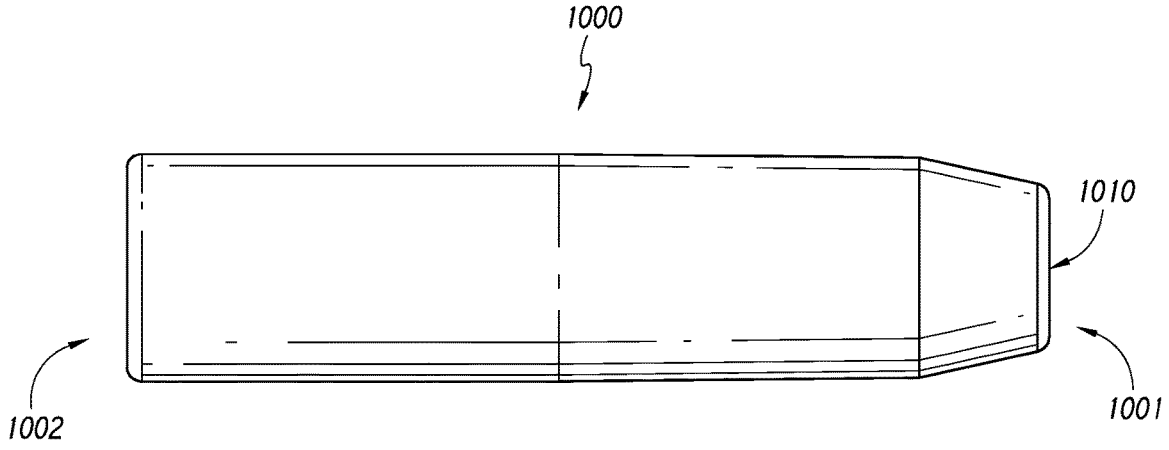
FIG. 2—A side view of a composite projectile of certain embodiments
Figure 3:
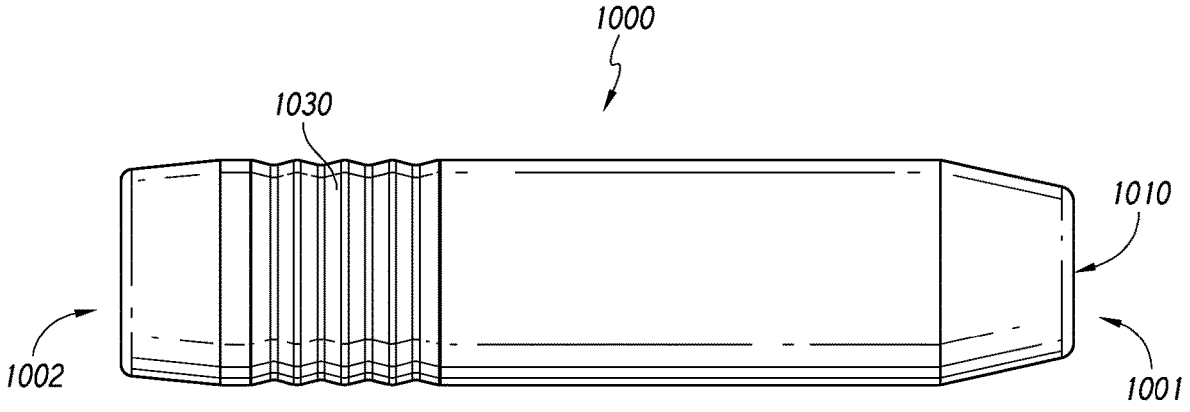
FIG. 3—A side view of a composite projectile of certain embodiments

Certain embodiments of the present invention comprise a composite projectile for use in applications such as door breaching and/or neutralization of organic and inorganic targets. Such embodiments comprise less than 10% polyamide, 85-95% of dense metal particles, such as tungsten, and up to 5% carbon particles having a maximum dimension of 50 microns. In certain embodiments, the carbon particles have a maximum dimension of 20 microns. It will be appreciated that in the context of the present application, percentages for the mixture of embodiments are provided by mass or weight. In certain embodiments, the dense metal particles have a maximum dimension of 250 microns, while in other embodiments it may be desired to use dense metal particles having a maximum dimension of 150 microns. When these particles are homogeneously mixed and formed through a melt-flow process, the characteristics imparted upon the resulting composite projectile provide rapid dissipation of energy when the composite projectile impacts a target. Such embodiments are designed to provide shrapnel-free and ricochet-free characteristics. It is a further aspect of such embodiments to prevent the destructive energy or particles from the composite projectile from traveling beyond the intended target area. The dense metal particles are typically of a metallic element or compound to provide a specified weight for a given caliber. Examples of a composite projectile 1000 for use in door breaching and/or neutralization of organic and inorganic targets are shown in FIG. 1-FIG. 3. Certain embodiments comprise a flat face 1010 at a leading end 1001 of the composite projectile to form what is commonly referred to as a "wadcutter" or "semi-wadcutter" tip, and a taper 1020 at a trailing end 1002 of the composite projectile to form what is commonly referred to as a "boat-tail." Certain embodiments comprise radial recesses 1030 at a medial portion of the composite projectile to form what are commonly referred to as "driving bands." Flat faces 1010 are commonly associated with projectiles having a lower muzzle velocity and are used to provide increased projectile expansion and deformation upon impact. A taper 1020 at a trailing end 1002 of a composite projectile serves to provide additional accuracy by reducing drag and making the composite projectile less susceptible to cross winds. Radial recesses 1030 are used to engage with the rifling of a barrel while limiting the drag on the composite projectile and wear on the barrel. The result is a faster muzzle velocity and less friction and degradation of the interior of the barrel. It may be desired for certain embodiments to comprise a composite projectile with lower levels of kinetic energy delivered to the target than embodiments comprising dense metal particles. Certain embodiments comprise iron or steel metal particles. Such embodiments deliver lower levels of kinetic energy for training purposes such as within a shoot-house.

It will be appreciated that the percentages as provided herein surround measurement of composition by weight, however it will be appreciated that such percentages can be applied in volumetric measurement while in keeping with the spirit and scope of the present invention.

Figure 4:
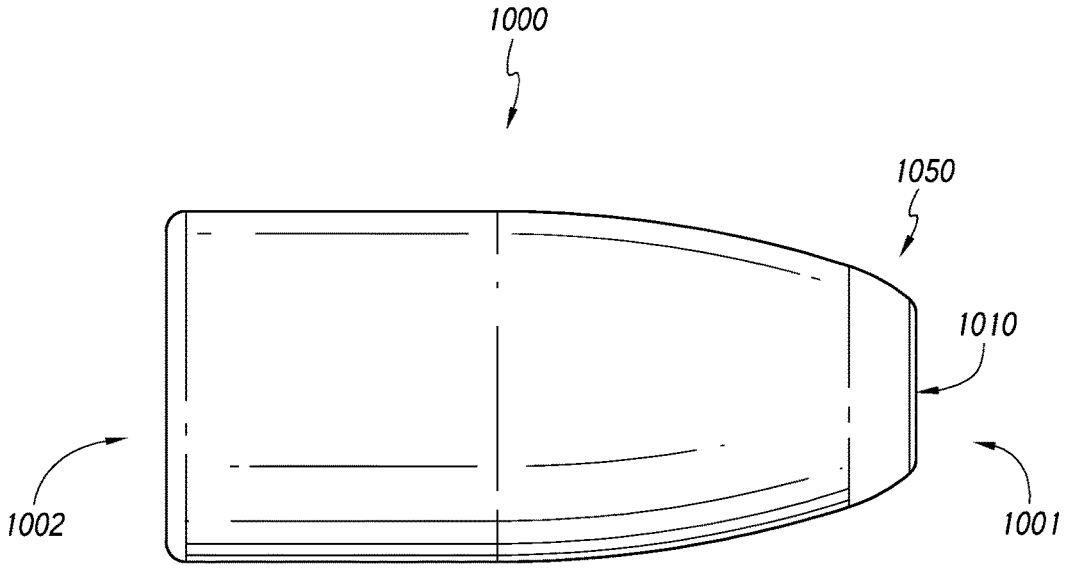
FIG. 4—A side view of a composite projectile of certain embodiments

Certain embodiments comprise a composite projectile for use in shrapnel-free and ricochet-free shooting practice as well as for the neutralization of organic and inorganic targets. Such embodiments comprise less than 10% of a polyamide, 85-95% of inexpensive metal particles such as aluminum or steel or iron, and up to 5% carbon particles having a maximum dimension of 50 microns. In certain embodiments, carbon particles have a maximum dimension of 20 microns. In certain embodiments, the metallic particles comprise a maximum dimension of 150 microns, while other embodiments comprise metallic particles having a maximum dimension of 250 microns. Homogeneous mixing and forming through a melt-flow process results in an inexpensive composite projectile which will not carry destructive outside the target area after striking a desired target. An example of a composite projectile 1000 for use in shrapnel-free and ricochet-free shooting practice as well as for the neutralization of organic and inorganic targets is shown in FIG. 4. Certain embodiments comprise a convex conical form 1050 with a flat face 1010.

Figure 5:
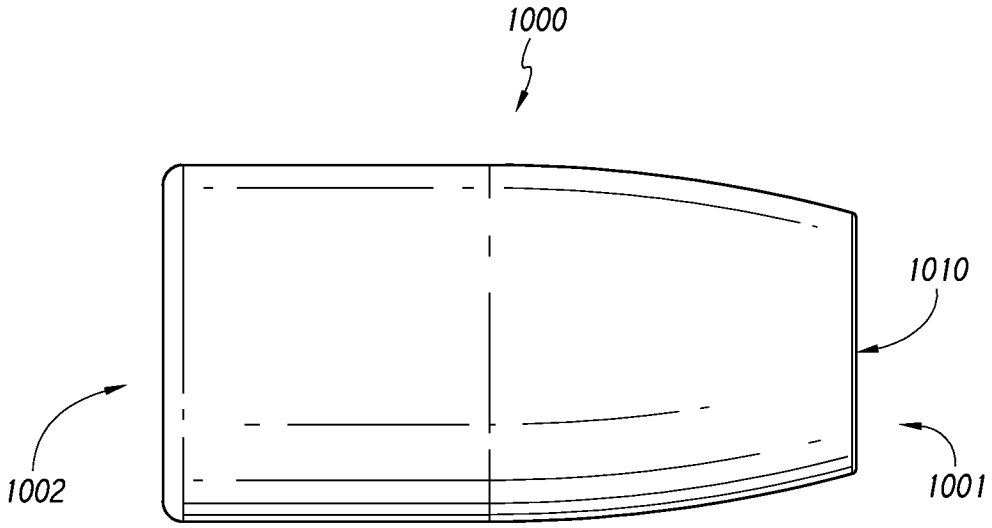
FIG. 5—A side view of a composite projectile of certain embodiments

Certain embodiments comprise a composite projectile which exhibits explosive characteristics upon impact with a target. Such embodiments comprise less than 10% of a polyamide or other polymer capable of being processed in a melt-flow or casting process. The composite projectile further comprises 25-90% of weight inducing particles such as metallic particles, 5-65% of energetic or explosive particles such as aluminum nanoparticles, and up to 5% of carbon particles having a maximum dimension of 50 microns. In certain embodiments, the carbon particles have a maximum dimension of 20 microns. In certain embodiments, the weight inducing particles have a maximum dimension of 250 microns, while other embodiments comprise metallic particles with maximum dimension of 150 microns. The homogeneous mixing and forming through a melt-flow process results in a composite projectile which will react explosively when it impacts a target. An example of a composite projectile 1000, shown in FIG. 5, exhibits explosive characteristics upon impact comprises a flat face 1010. The flat face 1010, as shown provides a more substantial area in relation to the composite projectile 1000, thus resulting in a higher than normal pressure event when the composite projectile 1000 strikes a given target. The higher than normal pressure event provides necessary pressure levels to initiate the explosive reaction of the composite projectile 1000.

Figure 6:
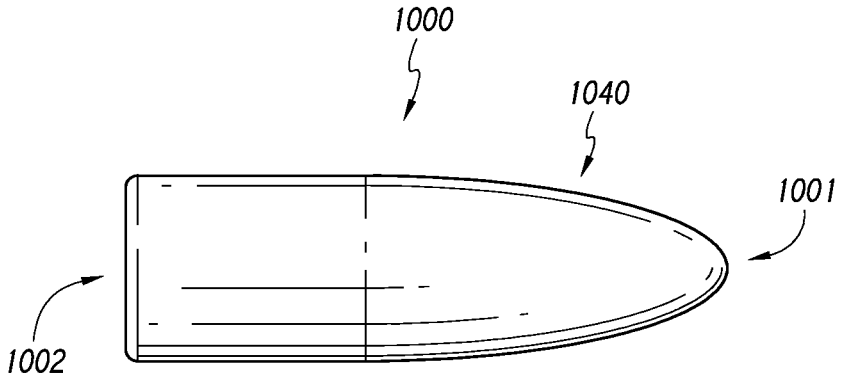
FIG. 6—A side view of a composite projectile of certain embodiments

Certain embodiments of the present invention comprise a composite projectile having uniquely identifiable characteristics to allow the composite projectile to be identified prior to and after the composite projectile has been fired from a weapon. Such embodiments comprise less than 10% of a polyamide or other polymer capable of being processed in a melt-flow or casting process and 85-95% of metal particles such as copper. In certain embodiments, the metal particles comprise a maximum dimension of 250 microns while other embodiments comprise a maximum dimension of 150 microns. The composite projectile further comprises up to 5% carbon particles having a maximum dimension of 50 microns or less, and less than 3% of unique identifying elements or molecules. In certain embodiments, the carbon particles have a maximum dimension of 20 microns. Homogeneous mixing and forming through a melt-flow process results in a composite projectile which is uniquely identifiable prior to and after use. It will be appreciated that synthetic molecules specifically made for the identification of composite projectiles may be used in the manufacture of such embodiments for increased identifiability. An example of a composite projectile 1000, shown in FIG. 6, having uniquely identifiable characteristics may be configured to be fired from any standard firearm. Certain embodiments, as shown, comprise a standard bulleted-nose 1040.

Figure 7:
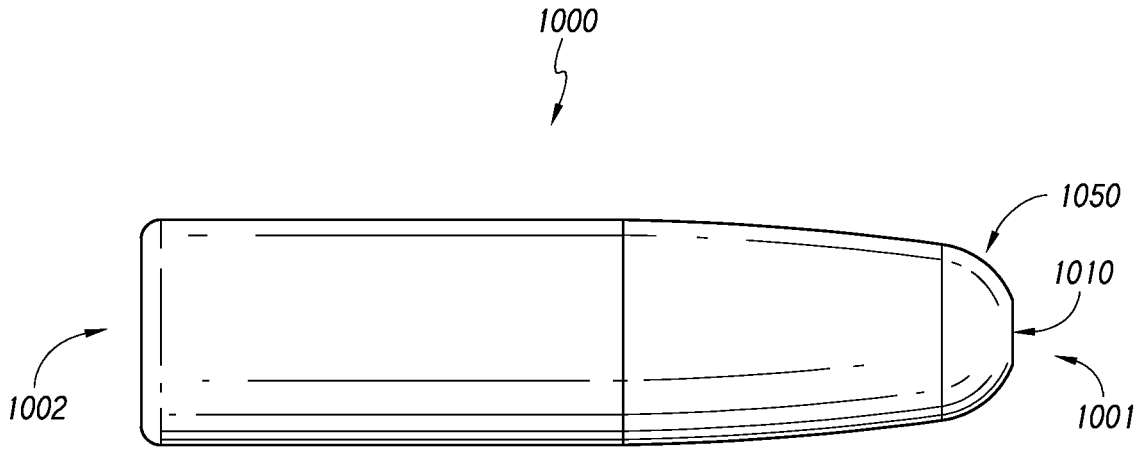
FIG. 7—A side view of a composite projectile of certain embodiments

Certain embodiments of the present invention comprise a composite projectile having less than 10% polyamide, 85-95% of metal particles, such as copper, and up to 5% carbon particles. In certain embodiments, the metal particles have a maximum dimension of 250 microns, while other embodiments comprise metal particles having a maximum dimension of 150 microns. In certain embodiments, the maximum dimension of the carbon particles comprises a maximum dimension of 20 microns, while other embodiments comprise a maximum dimension of 50 microns. It will be appreciated that composite projectiles may be designed to have a certain mass or density which may be tailored to a specific purpose through the variation of percentages. It will be further appreciated that composite projectiles of varying densities or masses may be produced using the same mold while varying the material composition of the composite projectile material mixture. An example of such an embodiment, as shown in FIG. 7, comprises a bulleted nose shape 1050 and a flat face 1010. It will be appreciated that such embodiments of varying densities can be configured to be fired from any standard firearm while remaining in spirit and scope of the present invention.

It will be appreciated that composite projectiles may undergo post-processing or secondary manufacturing processes to modify the composite projectile. It may be desired in certain embodiments to add coatings, apertures, and/or plugs to a composite projectile for purposes of modifying ballistic trajectory, reloading action or on-target characteristics.

Certain embodiments of the present invention surround ammunition casing for the firing of composite projectiles. Certain embodiments comprise a polymer-based casing. Certain embodiments comprise a steel casing. Certain embodiments comprise a casing having a combination of metal and polymer construction. Certain embodiments comprise a single-piece casing while others comprise multiple pieces assembled into a contiguous case. Such embodiments as disclosed are used to provide weight-reduction, increased reloadability, cost reductions, and or the ability to withstand higher pressures when a composite projectile is fired.

Figure 8:
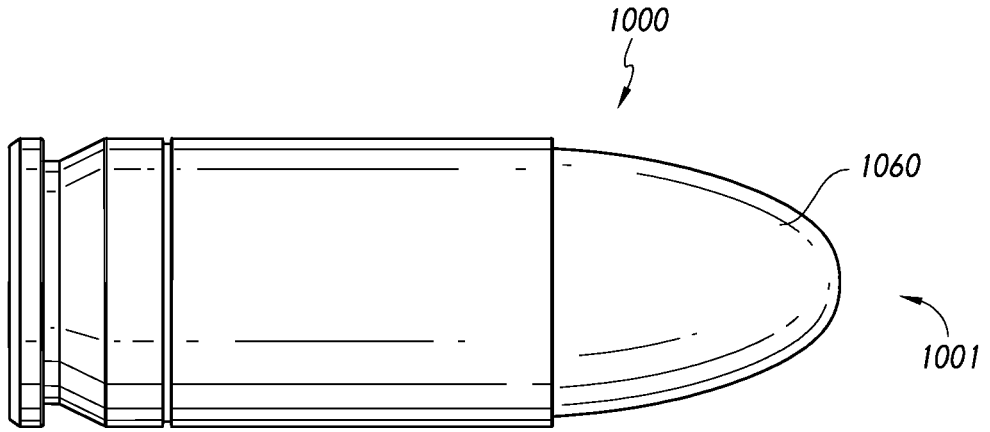
FIG. 8—A perspective view of a composite projectile of certain embodiments

It will be appreciated that embodiments such as composite projectiles and polymer-based casings result in composite projectiles and casings having a higher level of lubricity than found in the prior art. The increased lubricity of such embodiments allows for the mechanically driven reloading of a firearm with an unfired cartridge with less friction or resistance. Thus, resulting in increased reloadability with increased reliability, decreased frequency of mechanical failure events, and reduced wear on the reloading mechanisms of the firearm. An example of a composite projectile having increased lubricity is shown in FIG. 8, wherein a composite projectile 1000 further comprises an outer surface 1060 having a polymeric coating.

Certain embodiments comprise a composite projectile having a colorant added and homogeneously incorporated prior to the production of the composite projectile. This results in a composite projectile having a particular color or tint which is identifiable by the user of the composite projectile. It may be desired to color-code composite projectiles according to their intended purpose, allowing a user to identify composite projectiles for particular purposes by color, without a need for a secondary or post-processing step of coating or coloring.

Figure 9A:
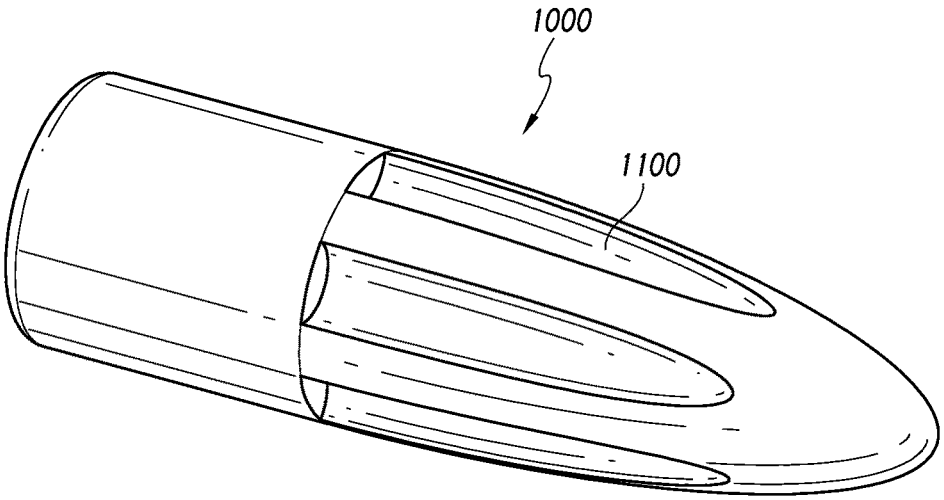
FIG. 9A—A perspective view of a composite projectile of certain embodiments
Figure 9B:
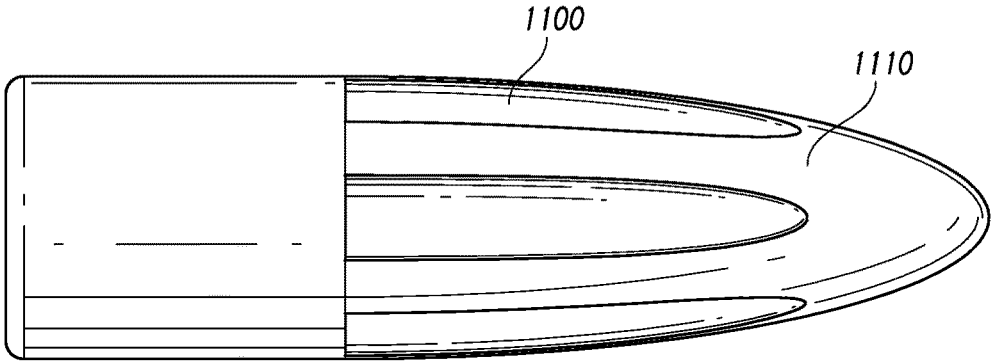
Figure 9C:
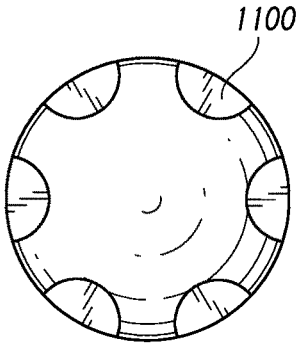

Certain embodiments, as shown in FIG. 9A-FIG. 9C, comprise a composite projectile having a drag-inducing element 1100. In certain embodiments, a drag-inducing element 1100 comprises a side-cut into the external surface 1110 of a composite projectile. In certain embodiments a drag-inducing element 1100 further comprises a plurality of fillets or chamfers into the external surface 1110 of a composite projectile. Although it is typically preferred that such drag-inducing elements 1100 are symmetrically configured around the external surface 1110 of the composite projectile, it will be appreciated that in certain use-cases drag-inducing elements 1100 are asymmetrically spaced around the external surface 1110 of the composite projectile are in keeping with the spirit and scope of the present invention. It will be further appreciated that the number of drag-inducing elements 1100 is not limited to a total of six as shown in FIG. 9A-FIG. 9C.

Figure 17A:
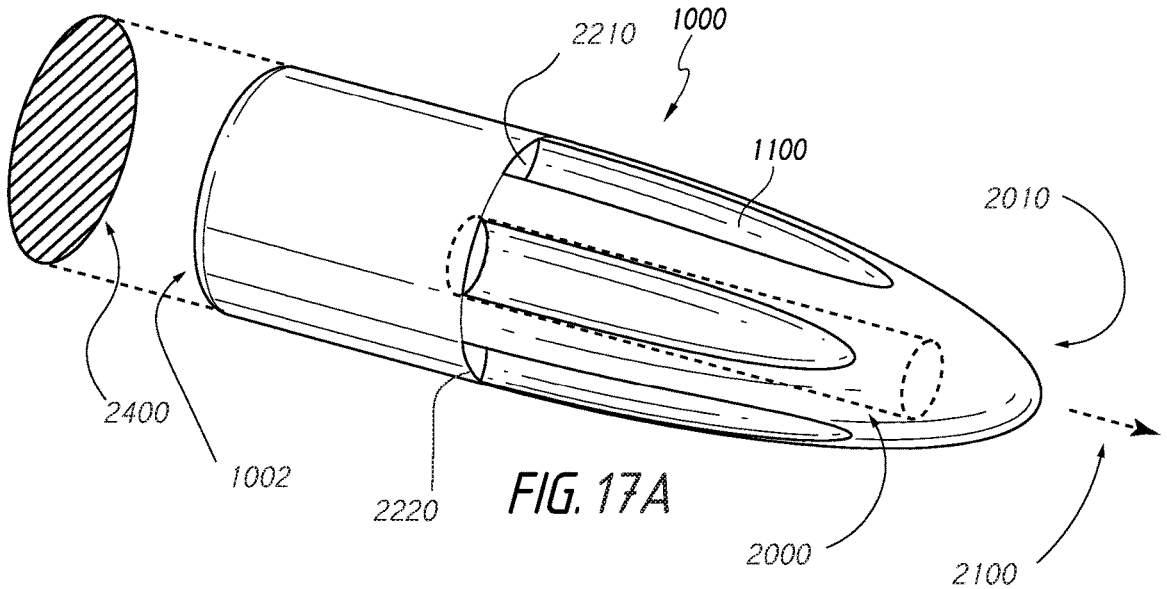
Figure 17B:
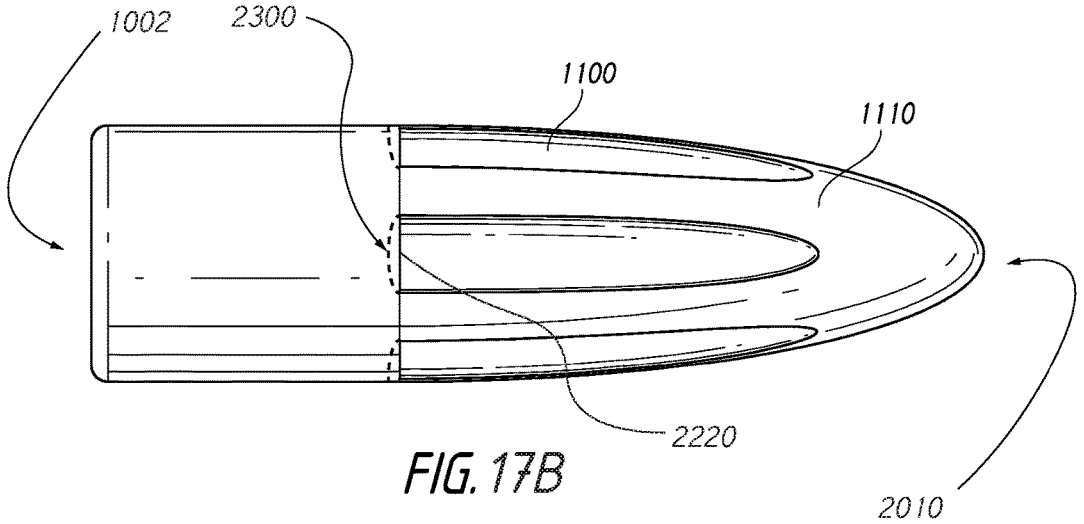
Figure 17C:
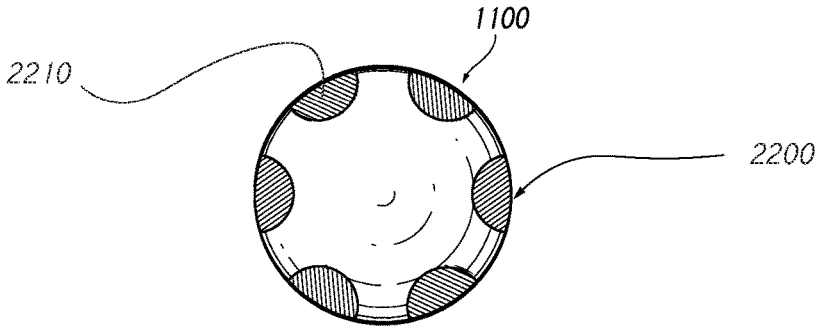

Referring once again to FIG. 9A-FIG. 9C and FIG. 17A-FIG. 17C, in certain embodiments the drag-inducing element 1100 of a projectile comprises a cylindrical cut 2000 in a forward aspect 2010, or the ogive of the projectile. Such drag-inducing elements 1100 can be oriented parallel to the path of travel 2100 of the projectile, as demonstrated in FIG. 17A while it is in keeping with the spirit and scope of the present invention for such cylindrical cuts to be askew from parallel from the path of travel 2100 of the projectile.

Referencing FIG. 9A-FIG. 9C and FIG. 17A-FIG. 17C, certain embodiments of the present invention comprise a drag-inducing element 1100 having a trailing aspect 2200 which is substantially orthogonal to the path of travel 2100 of the projectile. As used herein regarding the trailing aspect 2200 of a drag-inducing element, "substantially orthogonal" comprises a surface which is orthogonal to the path of travel 2100, a surface within 15-degrees of orthogonal to the path of travel 2100, or concave surface oriented toward the path of travel 2100 of the projectile. It will be appreciated that a concave surface directed toward the path of travel 2100 in the instant application comprises a surface 2210 of the trailing aspect of the drag-inducing element which extends toward the trailing end 1002 of the projectile further than the outer boundary 2220 of the trailing aspect of the drag-inducing element. It will be appreciated that the trailing aspects 2200 of a drag-inducing element are intended to induce turbulent flow, which disrupt the aerodynamics of a projectile in flight whereby the projectile tumbles and results in a rapid decrease in the effectiveness of projectile as it travels beyond the intended range of use.

It will be appreciated by those skilled in the art that the frontal area 2400 of a projectile is defined by the area of the projectile which is projected along the velocity vector or path of travel 2100. In certain embodiments of the present invention, the surface 2210 of trailing aspect 2200 of the drag-inducing elements comprise between 10%-80% of the frontal area 2400 of the projectile. In certain embodiments of the present invention, the surface 2210 of trailing aspect 2200 of the drag-inducing elements comprise between 12%-67% of the frontal area 2400 of the projectile. In certain embodiments of the present invention, the surface 2210 of trailing aspect 2200 of the drag-inducing elements comprise between 15%-60% of the frontal area 2400 of the projectile.

Figure 10:
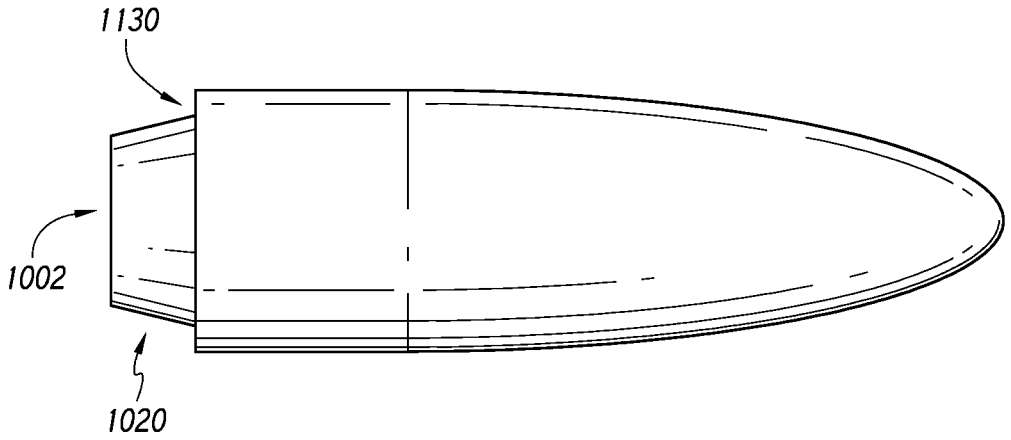
FIG. 10—A side view of a composite projectile of certain embodiments

Certain embodiments, as shown in FIG. 10, comprise a composite projectile having what is commonly referred to as a "rebated" base. A rebated base 1130 of a composite projectile, is commonly associated with a tapered base 1020 such as a boat-tail. A boat-tail surrounds the tapered base 1020 at the trailing end 1002 of a composite projectile. In certain embodiments a rebated base 1130 provides a 90-degree shoulder in conjunction with the boat-tail at the trailing end 1002 of the composite projectile.

Figure 11A:
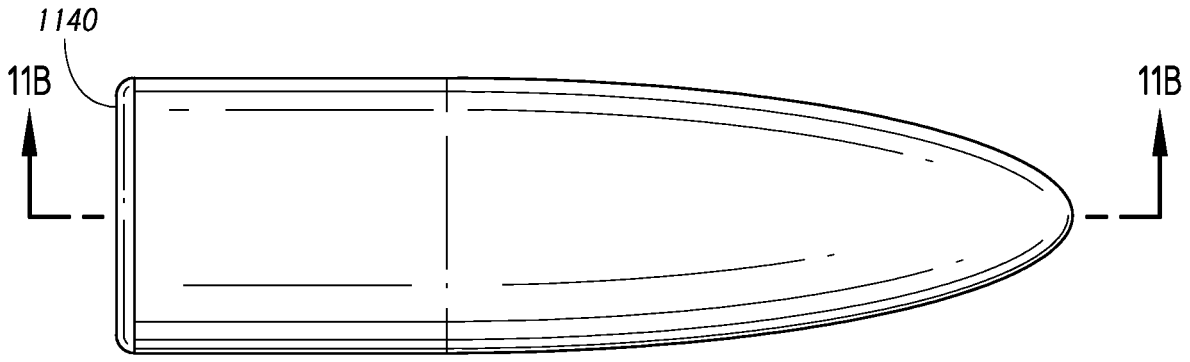
FIG. 11A—A side view of a composite projectiles of certain embodiments comprising a cap at a trailing end FIG. 11B—A cross-sectional view of a composite projectiles of certain embodiments comprising a cap at a trailing end FIG. 11C—A side view of a composite projectiles of certain embodiments comprising a cap at a trailing end FIG. 11D—A cross-sectional view of a composite projectiles of certain embodiments comprising a cap at a trailing end FIG. 11E—A side view of a composite projectiles of certain embodiments comprising a cap at a trailing end FIG. 11F—A cross-sectional view of a composite projectiles of certain embodiments comprising a cap at a trailing end FIG. 11G—A side view of a composite projectiles of certain embodiments comprising a cap at a trailing end FIG. 11H—A cross-sectional view of a composite projectiles of certain embodiments comprising a cap at a trailing end FIG. 12A—A side view of a composite penetrator of certain embodiments FIG. 12B A side view of a composite penetrator of certain embodiments FIG. 12C—A side view of a composite penetrator of certain embodiments FIG. 12D—A side view of a composite penetrator of certain embodiments FIG. 12E—A side view of a composite penetrator of certain embodiments FIG. 13A—A side view of a composite penetrator of certain embodiments FIG. 13B—A side view of a composite penetrator of certain embodiments FIG. 13C—A side view of a composite penetrator of certain embodiments FIG. 13D—A side view of a composite penetrator of certain embodiments FIG. 13E—A side view of a composite penetrator of certain embodiments FIG. 13F—A side view of a composite penetrator of certain embodiments FIG. 13G—A side view of a composite penetrator of certain embodiments FIG. 14A—A front view of an alignment element of certain embodiments FIG. 14B—A perspective view of an alignment element of certain embodiments FIG. 15—A cross-sectional view of a composite projectile of certain embodiments FIG. 16A—A perspective view of a composite projectile of certain embodiments FIG. 16B—A cross-sectional view of a composite projectile of certain embodiments FIG. 17A—A perspective view of a composite projectile of certain embodiments FIG. 17B—A side view of a composite projectile of certain embodiments FIG. 17C—A front view of a composite projectile of certain embodiments
Figure 11B:
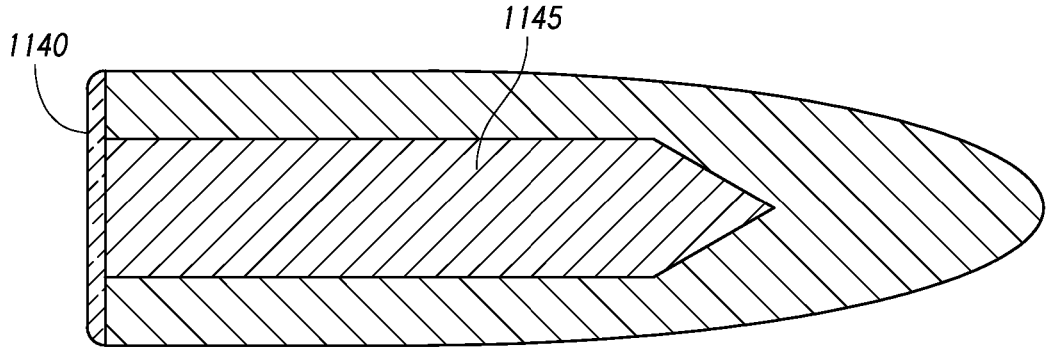
Figure 11C:
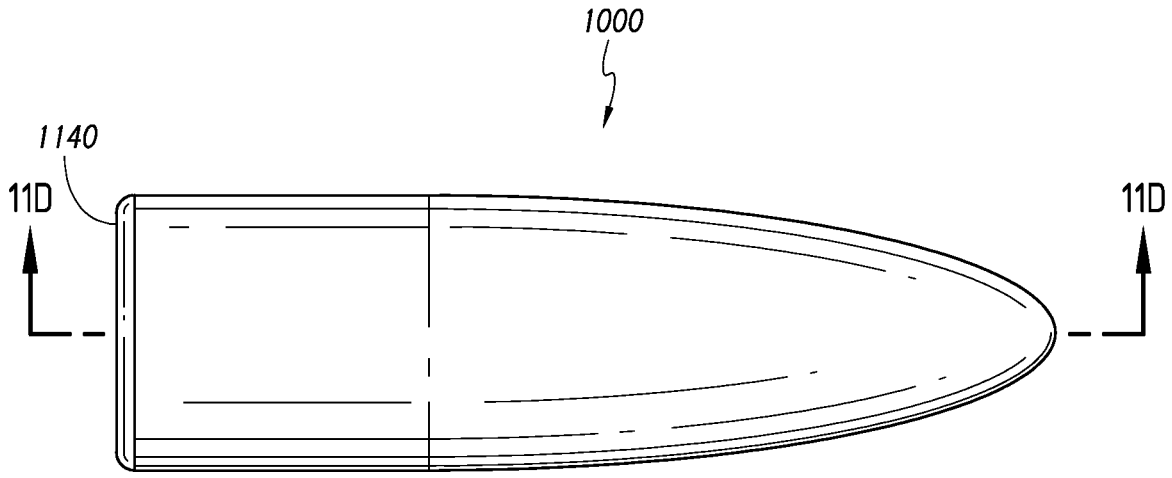
Figure 11D:
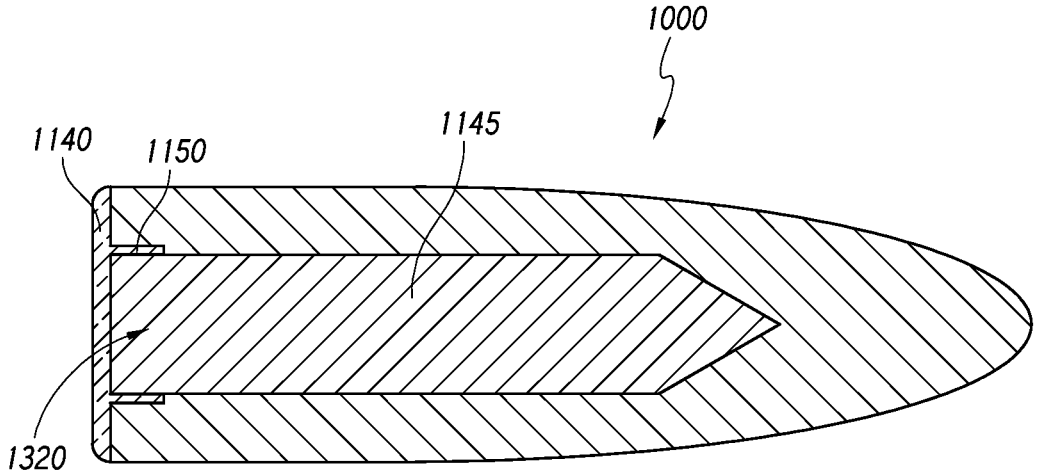
Figure 11E:
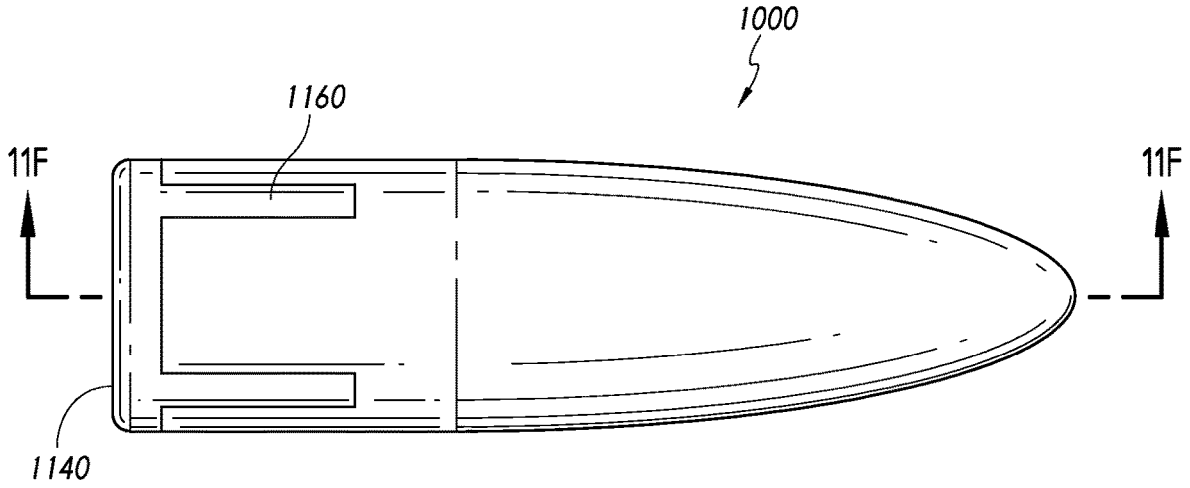
Figure 11F:
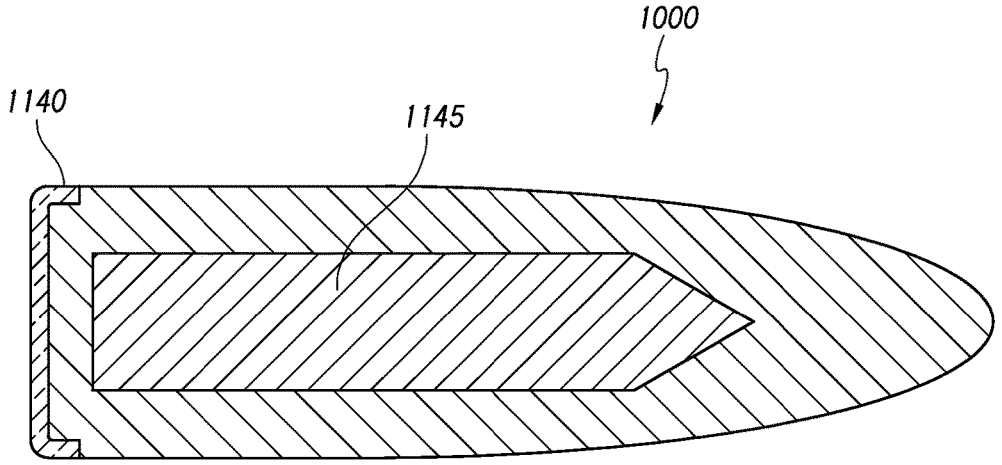
Figure 11G:
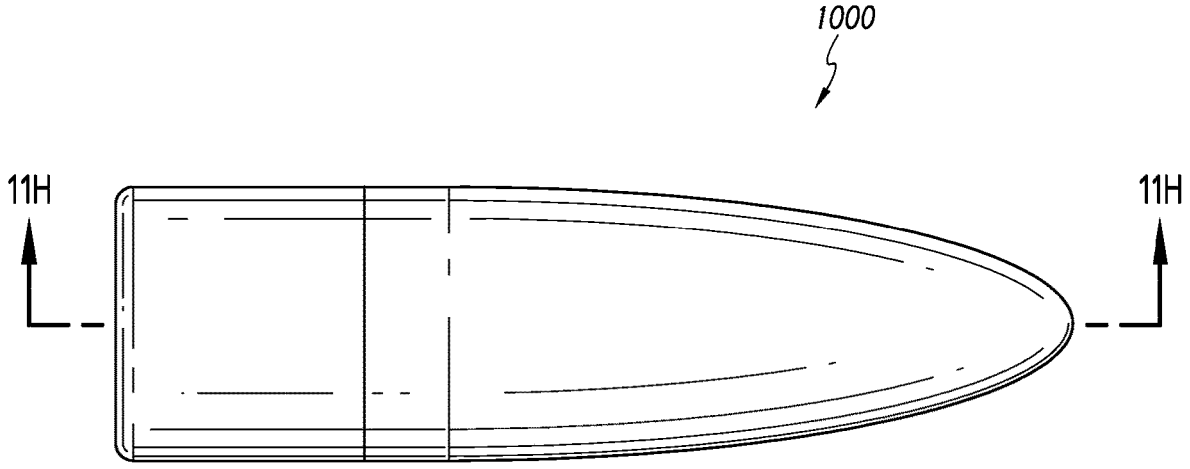
Figure 11H:
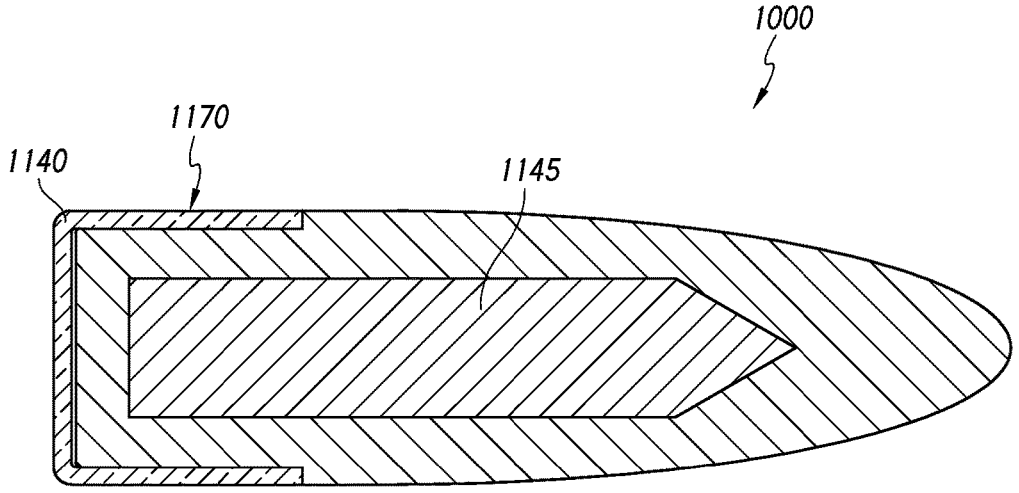

Certain embodiments, as seen in FIG. 11A-FIG. 11H, comprise a cap 1140 configured to shield the trailing end 1002 of a composite projectile from the heat and pressure associated with a propelling charge. A cap 1140 of certain embodiments comprises a copper or cupronickel material, however it will be appreciated that use other materials known to those in the art are in keeping with the spirit and scope of the present invention. In certain embodiments, as seen in FIG. 11A-FIG. 11B, a cap 1140 comprises a form which covers the trailing end 1002 of the composite projectile. In certain embodiments, as shown in FIG. 11C-FIG. 11D, a cap 1140 comprises a form which covers the trailing end 1002 of a composite projectile, and further comprises an alignment element 1150. The alignment element 1150 of certain embodiments, as shown in FIG. 11C-FIG. 11D is characterized by a central recess which is configured to receive the trailing end 1320 of a hardened penetrator. An alignment element in such embodiments serves to align a hardened penetrator 1145 with the cap 1140 and thereby the composite projectile 1000 in preparation for the molding process. In certain embodiments, as shown in FIG. 11E-FIG. 11F, comprises a cap 1140 which covers the trailing end 1002 of the composite projectile 1000, and further comprises fingers 1160 which extend toward the leading end 1001 of the composite projectile. The fingers 1160 of such embodiments serve to provide increased attachment of the cap 1160 to the composite projectile as well as to engage with the rifling of the barrel of a firearm. In certain embodiments, as shown in FIG. 11G-FIG. 11H, it may be desired for the cap 1140 to further comprise a collar 1170 which extends toward the leading end 1001 of a composite projectile. The collar 1170 of such embodiments serves to provide increased attachment of the cap 1140 to the composite projectile 1145 as well as to engage with the rifling of the barrel of a firearm. It will be appreciated that a cap as disclosed herein surrounds the shielding of the leading end of a composite projectile. However, it will be further appreciated that a cap of certain embodiments is disposed at the leading end of a composite projectile and configured to shield the leading end of the composite projectile while in keeping with the spirit and the scope of the present invention.

It is an aspect of certain embodiments of the present invention to prevent the shifting of a hardened penetrator within projectile such as caused by the heat from initiation of a propelling charge. In certain embodiments, a cap is affixed to the trailing end 1002 of a composite projectile to shield the base of the composite projectile from the heat of the initiation of the propelling charge.

Figure 12A:
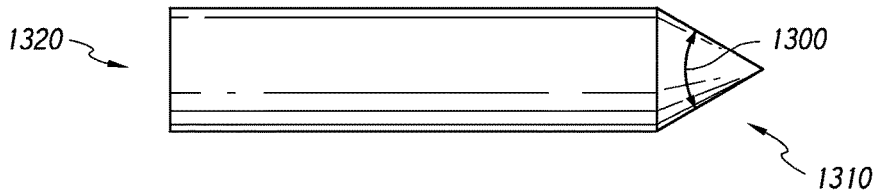
Figure 12B:
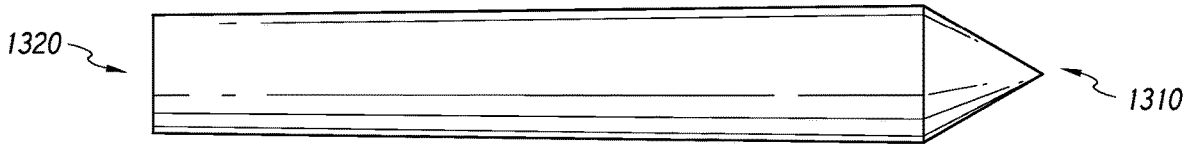
Figure 12C:
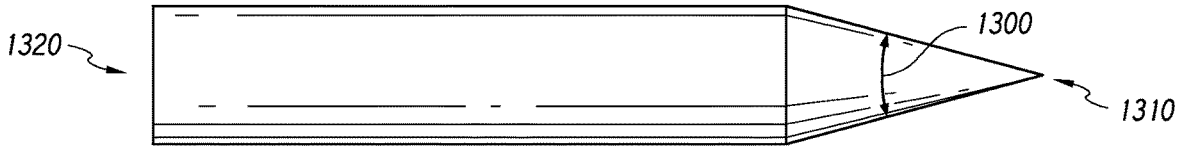
Figure 12D:
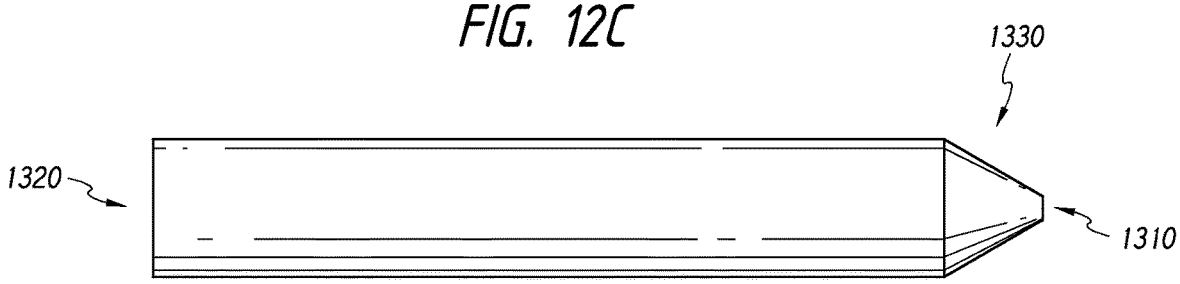
Figure 12E:
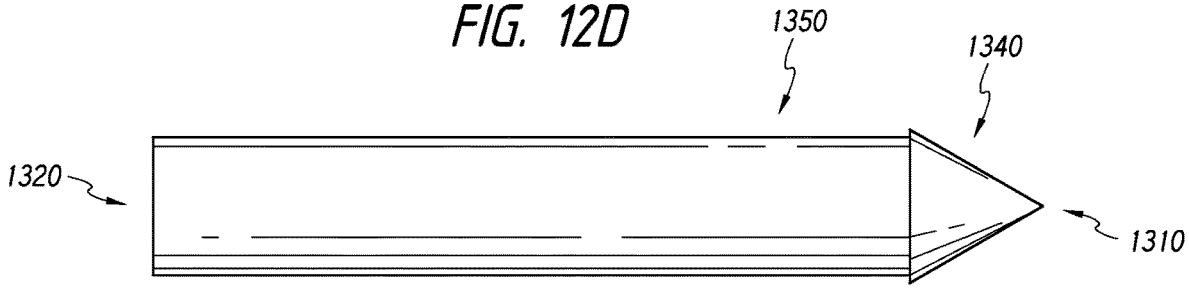

In certain embodiments, as shown in FIG. 12A-FIG. 12E, a hardened penetrator 1145 of the present invention can comprise a number of profiles. In certain embodiments, as shown in FIG. 12A, a hardened penetrator comprises a 60-degree included angle 1300 and a consistent profile. In certain embodiments, as shown in FIG. 12B, a hardened penetrator 1145 comprises a profile which tapers down from the leading end 1310 toward the trailing end 1320 of the hardened penetrator. In certain embodiments, as shown in FIG. 12C, a hardened penetrator 1145 comprises a 30-degree included angle 1300 which serves to provide more piercing ability for the hardened penetrator 1145. As seen in FIG. 12D, certain embodiments comprise a hardened penetrator having a frustum 1330 at the leading end 1001. The flat portion of the frustum provides more blunt force impact by the hardened penetrator against a hard target for purposes of fracturing the target versus piercing the target. In certain embodiments, as shown in FIG. 12E, a hardened penetrator 1145 comprises a conical tip 1340 with a rebated body 1350, thus once the leading end 1001 of the hardened penetrator traverses through the target, the rebated body 1350 of the hardened penetrator 1145 follows without impedance.

Figure 13A:
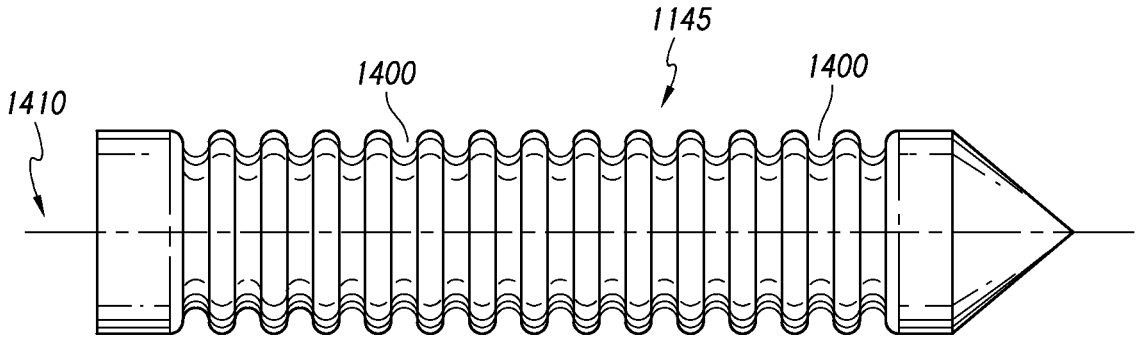
Figure 13B:
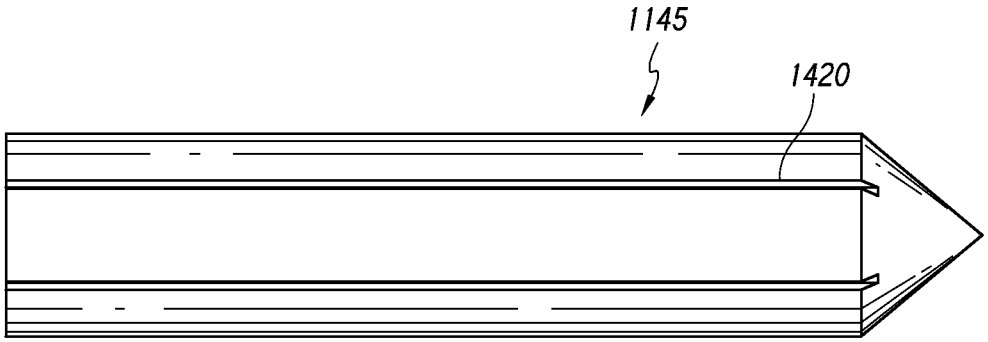
Figure 13C:
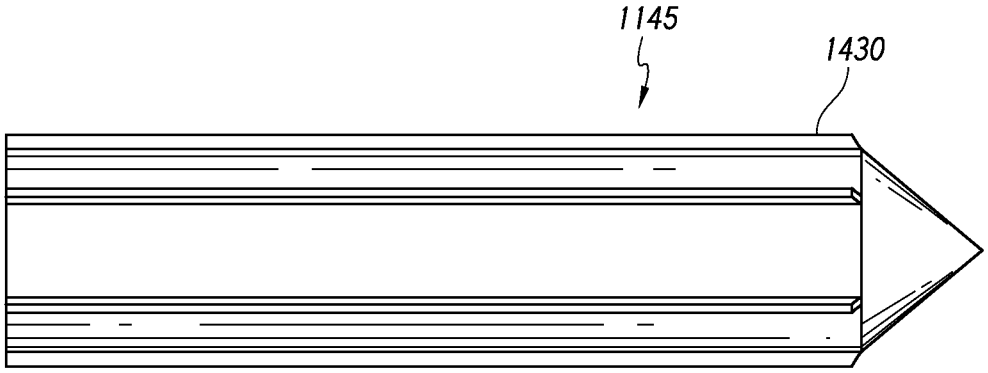
Figure 13D:
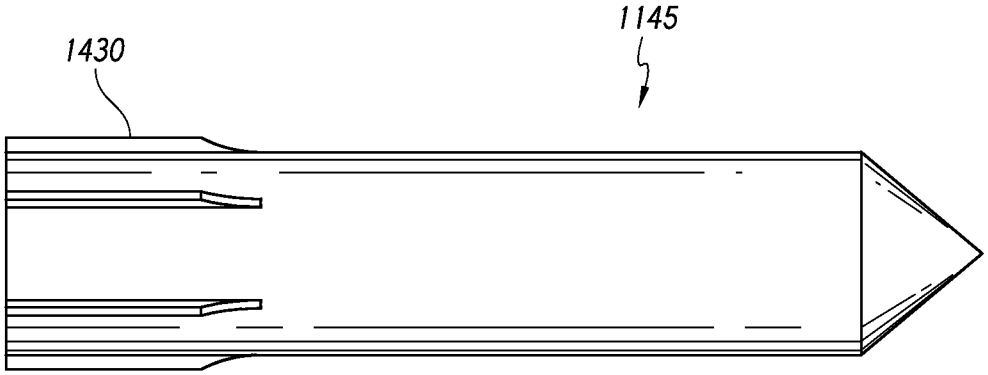
Figure 13E:
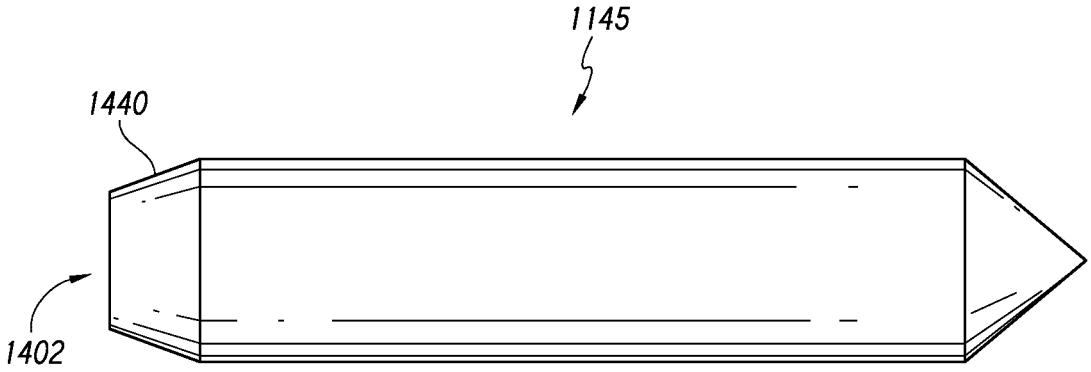
Figure 13F:
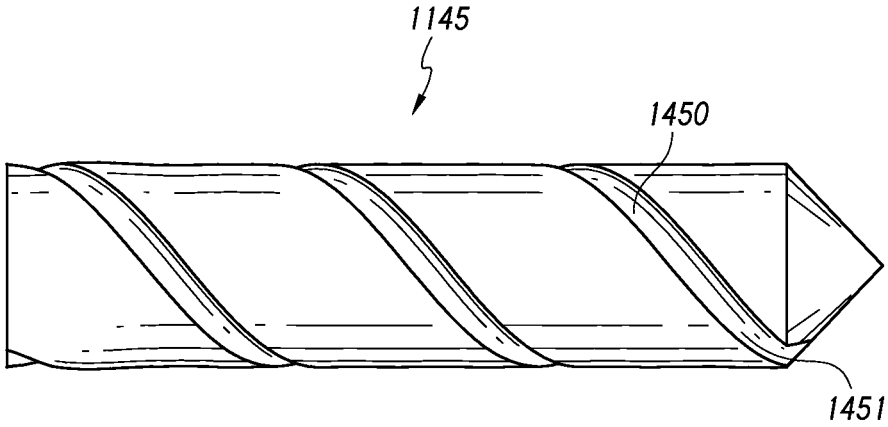
Figure 13G:
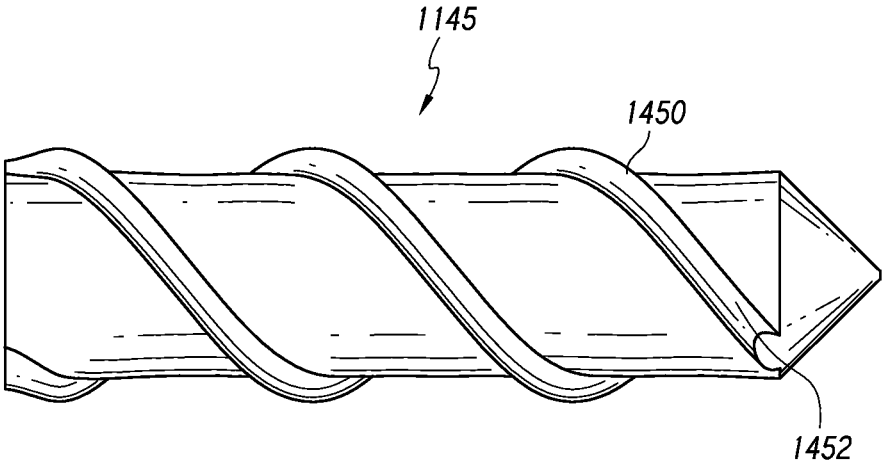

As seen in FIG. 13A-FIG. 13G, certain embodiments comprise hardened penetrators 1145 having external features. As seen in FIG. 13A, a hardened penetrator 1145 of certain embodiments comprises an annular recess 1400 substantially perpendicular to the longitudinal axis 1410 of the hardened penetrator. Certain embodiments comprise a plurality of annular recesses 1400. In certain use cases, such annular recesses 1400 serve to reduce friction when passing through soft armor and allowing a composite projectile to traverse further within soft armor due to increased surface area for binding with the polymer of a composite projectile. As seen in FIG. 13B, certain embodiments comprise longitudinal channels 1420 along the length of a hardened penetrator 1145 for reduced surface area for interaction with a target as well as increased surface area for binding with a polymer of a composite projectile. In certain embodiments, as shown in FIG. 13C-FIG. 13D, a hardened penetrator 1145 comprises longitudinal fins 1430. In certain embodiments, as seen in FIG. 13E, a hardened penetrator 1145 comprises a boat-tail 1440 at the trailing end 1402 of the hardened penetrator. In certain embodiments, as seen in FIG. 13F-FIG. 13G, a hardened penetrator 1145 comprises a helical element 1450, such as a helical groove 1451 or helical protuberance 1452, on the external surface 1460 of the hardened penetrator. In certain use cases, such helical elements 1450 induce axial spinning and allow the hardened penetrator 1145 to pass more easily through a soft armor such as those using aramid fiber based textiles.

Figure 14A:
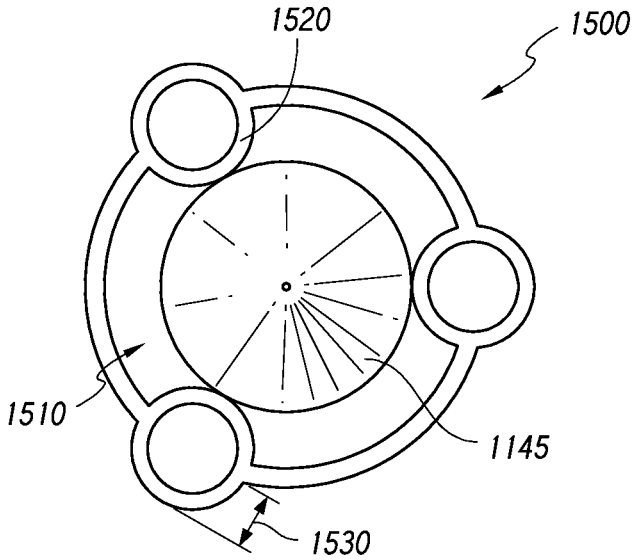
Figure 14B:
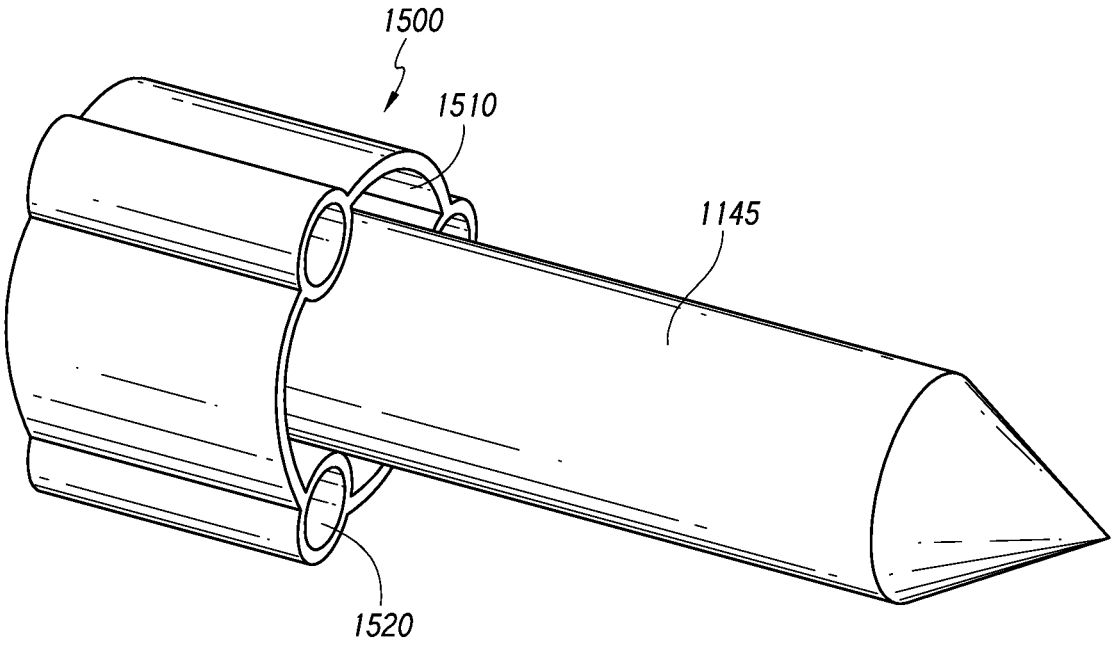

In certain embodiments, as shown in FIG. 14A-FIG. 14B, an alignment element 1500 provides alignment for a hardened penetrator 1145 within a composite projectile. In certain embodiments the alignment element 1500 comprises a recess 1510 configured to receive the hardened penetrator 1145, and offset elements 1520 configured to maintain a consistent radial offset 1530 from external aspects of a resulting projectile. In certain embodiments, the alignment element 1500 comprises a material makeup substantially consistent with the polymeric make-up of the composite projectile. As such, when the composite projectile is molded, the alignment element becomes integrated with the composite projectile. In certain embodiments, the alignment element 1500 comprises a metallic composition. In certain embodiments the alignment element 1500 comprises an open-celled matrix or foam structure such as a polymer, metal, or ceramic—configured to allow the permeation of a molten polymer into and around the structure of the alignment element 1500.

Figure 15:
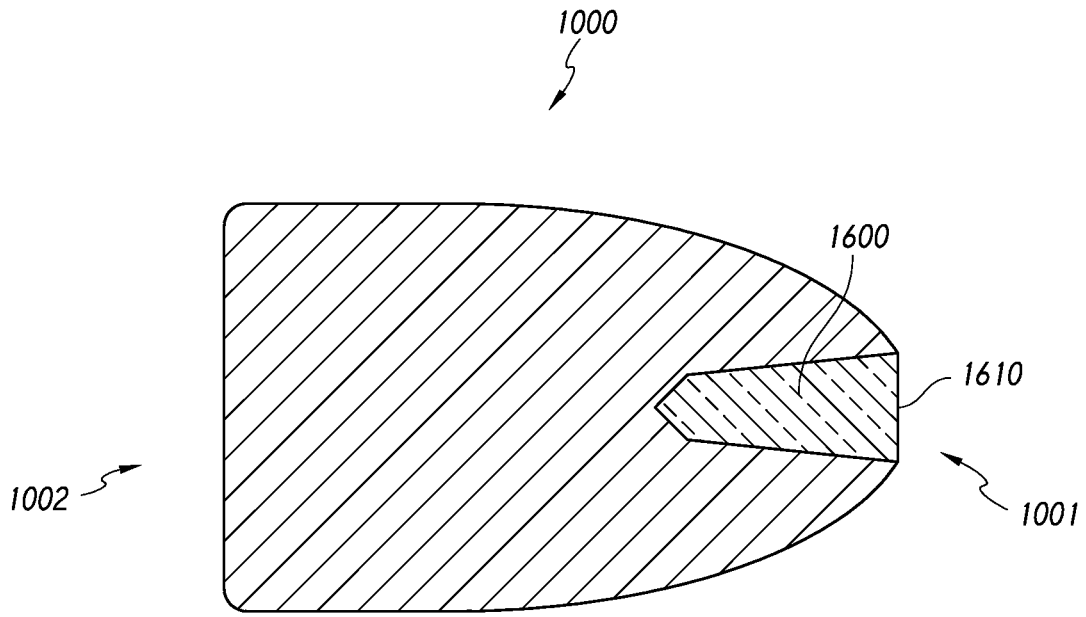

In certain embodiments, shown in FIG. 15, a composite projectile 1000 is configured for fragmentation such that an expansion inducing element 1600 at the leading end 1001 of the composite projectile creates outward fragmentation upon impact with a target. In certain embodiments, the expansion inducing element 1600 comprises a conical form having a base 1610 at the leading end 1001 of the composite projectile and tapers inward toward the trailing end 1002 of the composite projectile. It will be appreciated that certain embodiments comprise a double-conical form (not shown) wherein a first conical element has a base affixed to a base of a second conical element. Thus, resulting in a tip of the first conical element at the leading end 1001 of the composite projectile, and the tip of the second conical element offset toward the trailing end 1002 of the composite projectile.

Figure 16A:
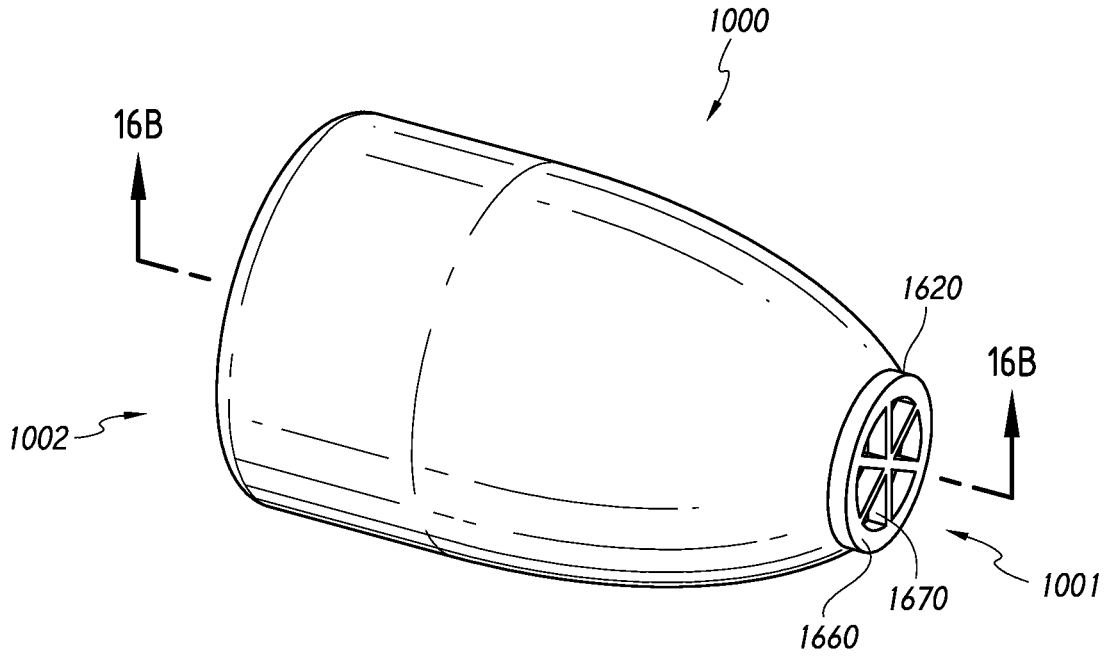
Figure 16B:
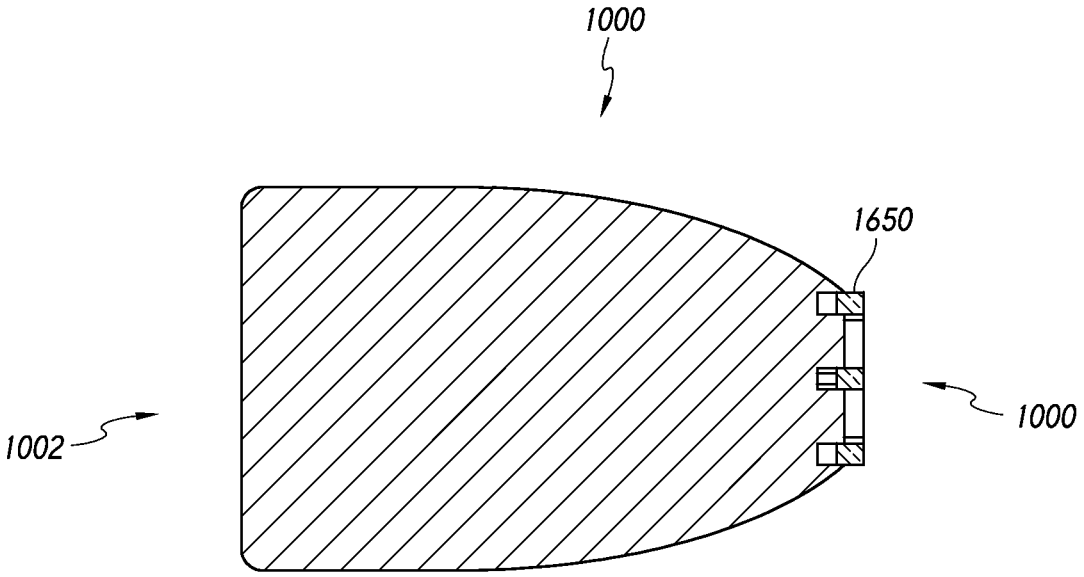

In certain embodiments, shown in FIG. 16, an expansion inducing element 1650 comprises a segmented element characterized by solid aspects 1660 and perforations 1670. Such an expansion inducing element serves to control the fragmentation patterning and expansion of the composite projectile 1000 upon impact.

For purposes of further disclosure, the following references generally related to projectiles and manufacturing methods are hereby incorporated by reference in their entireties:

U.S. Pat. No. 9,383,178 to Powers, issued on Jul. 5, 2016, which discloses a Hollow point bullet and method of manufacturing same;

U.S. Pat. No. 9,188,416 to Hash et al., issued on Nov. 17, 2015, which discloses lead-free, corrosion-resistant projectiles and methods of manufacture;

U.S. Pat. No. 9,057,591 to Hash et al., issued on Jun. 16, 2015, which discloses lead-free, corrosion-resistant projectiles and methods of manufacture;

U.S. Pat. No. 8,833,262 to Leasure, issued on Sep. 16, 2014, which discloses a lead-free reduced ricochet limited penetration projectile;

U.S. Pat. No. 7,992,500 to Williams, issued on Aug. 9, 2011, which discloses a method and apparatus for self-destruct frangible projectiles;

U.S. Pat. No. 5,616,642 to West et al., issued on Apr. 1, 1997, which discloses a lead-free frangible ammunition;

U.S. Pat. No. 5,237,930 to Belanger et al., issued on Aug. 24, 1993, which discloses a frangible practice ammunition;

U.S. Pat. No. 9,388,090 to Joshi et al., issued on Jul. 12, 2016, which discloses a fast ignition and sustained combustion of ionic liquids;

U.S. Pat. No. 9,372,054 to Padgett, issued on Jun. 21, 2016, which discloses a narrowing high strength polymer-based cartridge casing for blank and subsonic ammunition;

U.S. Pat. No. 9,227,353 to Williams, issued on Jan. 5, 2016, which discloses a molding apparatus and method for operating same;

U.S. Pat. No. 9,194,680 to Padgett et al., issued on Nov. 24, 2015, which discloses polymer-based machine gun belt links and cartridge casings and manufacturing method;

U.S. Pat. No. 9,046,333 to Masinelli, issued on Jun. 2, 2015, which discloses a bullet;

U.S. Pat. No. 8,997,653 to Calvert, issued on Apr. 7, 2015, which discloses a stroke inducing bullet;

U.S. Pat. No. 8,893,621 to Escobar, issued on Nov. 25, 2014, which discloses a projectile;

U.S. Pat. No. 8,881,654 to Seecamp, issued on Nov. 11, 2014, which discloses bullets with lateral damage stopping power;

U.S. Pat. No. 8,393,273 to Weeks, issued on Mar. 12, 2013, which discloses bullets, including lead-free bullets, and associated methods;

U.S. Pat. No. 8,365,672 to Martinez, issued on Feb. 5, 2013, which discloses a frangible bullet and its manufacturing method;

U.S. Pat. No. 8,312,815 to Joys et al., issued on Nov. 20, 2012, which discloses lead free frangible bullets;

U.S. Pat. No. 8,225,718 to Joys et al., issued on Jul. 24, 2012, which discloses lead free frangible bullets;

U.S. Pat. No. 8,308,986 to Stuart, issued on Nov. 13, 2012, which discloses a bismuth compounds composite;

U.S. Pat. No. 5,035,183 to Luxton, issued on Jul. 30, 1991, which discloses a frangible nonlethal projectile;

U.S. Pat. No. 6,149,705 to Richard A. Lowden et al, issued on Nov. 21, 2000, which discloses environmentally safe projectiles made of two different metals, one that is significantly more malleable and acts as a binder to the higher density material and forms the shape of the bullet under compression;

U.S. Pat. No. 10,126,105 to Paul Lemke, et al., issued on Nov. 13, 2018 which discloses projectiles having notches configured to improve the aerodynamics of the projectile; and U.S. patent application Ser. No. 15/495,367, to Folaron et al., filed on Apr. 24, 2017, which discloses an injection molding apparatus and method of use.

While various embodiments of the present invention have been described in detail, it is apparent that modifications and alterations of those embodiments will occur to those skilled in the art. However, it is to be expressly understood that such modifications and alterations are within the scope and spirit of the present invention. Further, the inventions described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as, additional items.

What is claimed:

1. A composite projectile, comprising:

a leading end, and a trailing end;

at least one drag-inducing element comprising a side-cut into an external surface of a composite projectile;

the at least one drag-inducing element further comprising a trailing aspect, the at least one drag-inducing element being a plurality of drag-inducing elements radially distributed around the leading end of the projectile, the respective side-cuts of each drag-inducing element each comprising a cylindrical form, each cylindrical form being parallel to a path of travel of the composite projectile;

the trailing aspect of the at least one drag-inducing element having a surface which is substantially orthogonal to the path of travel of the composite projectile; and wherein, the composite projectile comprises a mixture comprising (by weight): greater than 0% and less than 10% of a polymer; 85-95% metallic particles, the metallic particles having a maximum dimension of 250 microns; and greater than 0% and up to 5% of carbon particles having a maximum dimension of 50 microns, wherein the mixture is homogeneously incorporated and processed in a melt-flow manufacturing process.

2. A composite projectile, comprising:

a leading end;

a trailing end; and at least one drag-inducing element comprising a side-cut into an external surface of a composite projectile, the at least one drag-inducing element further comprising a trailing aspect, the trailing aspect of the at least one drag-inducing element having a surface which is substantially orthogonal to the path of travel of the composite projectile, the at least one drag-inducing element comprising a plurality of drag-inducing elements radially distributed around the leading end of the projectile, each surface of the trailing aspects of the drag-inducing elements being a concave form that extends toward the trailing end of the projectile further than an outer boundary of the trailing aspect of the drag-inducing element;

wherein, the composite projectile comprises a mixture comprising (by weight):

greater than 0% and less than 10% of a polymer;

85-95% metallic particles, the metallic particles having a maximum dimension of 250 microns; and greater than 0% and up to 5% of carbon particles having a maximum dimension of 50 microns, wherein the mixture is homogeneously incorporated and processed in a melt-flow manufacturing process.

3. A composite projectile, comprising:

a leading end;

a trailing end; and at least one drag-inducing element comprising a side-cut into an external surface of a composite projectile, the at least one drag-inducing element further comprising a trailing aspect, the trailing aspect of the at least one drag-inducing element having a surface which is substantially orthogonal to the path of travel of the composite projectile, the at least one drag-inducing element further comprising a plurality of drag-inducing elements radially distributed around the leading end of the projectile, each surface of the trailing aspect of the drag-inducing elements comprising between 10% and 80% of a frontal area of the composite projectile;

wherein, the composite projectile comprises a mixture comprising (by weight):

greater than 0% and less than 10% of a polymer;

85-95% metallic particles, the metallic particles having a maximum dimension of 250 microns; and greater than 0% and up to 5% of carbon particles having a maximum dimension of 50 microns, wherein the mixture is homogeneously incorporated and processed in a melt-flow manufacturing process.

4. A composite projectile, comprising:

a leading end;

a trailing end; and at least one drag-inducing element comprising a side-cut into an external surface of a composite projectile, the at least one drag-inducing element further comprising a trailing aspect, the trailing aspect of the at least one drag-inducing element having a surface which is substantially orthogonal to the path of travel of the composite projectile, the at least one drag-inducing element further comprising a plurality of drag-inducing elements radially distributed around the leading end of the projectile, each surface of the trailing aspect of the drag-inducing elements comprising between 12% and 67% of a frontal area of the composite projectile;

wherein, the composite projectile comprises a mixture comprising (by weight):

greater than 0% and less than 10% of a polymer;

85-95% metallic particles, the metallic particles having a maximum dimension of 250 microns; and greater than 0% and up to 5% of carbon particles having a maximum dimension of 50 microns, wherein the mixture is homogeneously incorporated and processed in a melt-flow manufacturing process.

5. A composite projectile, comprising:

a leading end;

a trailing end; and at least one drag-inducing element comprising a side-cut into an external surface of a composite projectile, the at least one drag-inducing element further comprising a trailing aspect, the trailing aspect of the at least one drag-inducing element having a surface which is substantially orthogonal to the path of travel of the composite projectile, the at least one drag-inducing element further comprising a plurality of drag-inducing elements radially distributed around the leading end of the projectile, each surface of the trailing aspect of the drag-inducing elements comprising between 15% and 60% of a frontal area of the composite projectile;

wherein, the composite projectile comprises a mixture comprising (by weight):

greater than 0% and less than 10% of a polymer;

85-95% metallic particles, the metallic particles having a maximum dimension of 250 microns; and greater than 0% and up to 5% of carbon particles having a maximum dimension of 50 microns, wherein the mixture is homogeneously incorporated and processed in a melt-flow manufacturing process.

* * * * *